US007644837B2

(12) United States Patent
Hatsuno et al.

(10) Patent No.: US 7,644,837 B2
(45) Date of Patent: Jan. 12, 2010

(54) MEDICINE SUPPLY APPARATUS

(75) Inventors: Akinorl Hatsuno, Gunma-ken (JP); Atsuo Inamura, Ota (JP); Hideyuki Takahashi, Ota (JP); Takashi Mori, Ota (JP); Koichi Kobayashi, Ota (JP); Manabu Haraguchi, Gunma-ken (JP); Masayoshi Ogura, Tsukuba (JP); Toshitake Maruyama, Kumagaya (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 152 days.

(21) Appl. No.: 11/337,682

(22) Filed: Jan. 24, 2006

(65) Prior Publication Data

US 2006/0163271 A1 Jul. 27, 2006

(30) Foreign Application Priority Data

Jan. 27, 2005 (JP) ..... 2005/019581
Jan. 27, 2005 (JP) ..... 2005/019591
Jan. 27, 2005 (JP) ..... 2005/019617

(51) Int. Cl.
*B65H 3/44* (2006.01)

(52) U.S. Cl. ..... 221/95; 221/112; 700/239

(58) Field of Classification Search ..... 221/95, 221/112; 700/239
See application file for complete search history.

(56) References Cited

U.S. PATENT DOCUMENTS 5,097,652 A * 3/1992 Inamura et al. ..... 53/493
5,208,762 A * 5/1993 Charhut et al. ..... 700/216
5,597,995 A * 1/1997 Williams et al. ..... 700/231
5,812,410 A * 9/1998 Lion et al. ..... 700/231
5,853,911 A * 12/1998 Tetzlaff et al. ..... 429/41
5,946,883 A * 9/1999 Yuyama et al. ..... 53/154
6,036,812 A * 3/2000 Williams et al. ..... 156/277
6,085,938 A 7/2000 Coughlin
6,592,005 B1 7/2003 Coughlin et al.
6,948,635 B2 * 9/2005 Kobayashi ..... 221/264

* cited by examiner

*Primary Examiner*—Gene Crawford
*Assistant Examiner*—Timothy R Waggoner
(74) *Attorney, Agent, or Firm*—Kratz, Quintos & Hanson, LLP

(57) ABSTRACT

An object of a medicine supply apparatus which fills medicine bottles with medicines from a plurality of tablet cases is to improve a medicine filling performance and remove restrictions on the apparatus, and the apparatus comprises: a plurality of tablet cases which contain the medicines and into which the medicines can be thrown from above; a case storage section in which the respective tablet cases are juxtaposed in one stage on a plane and whose top is openably closed; and a filling device which is disposed under this case storage section and which fills the medicine bottle with the medicine dropping from each tablet case.

16 Claims, 20 Drawing Sheets

MEDICINE SUPPLY APPARATUS

BACKGROUND OF THE INVENTION

The present invention relates to a medicine supply apparatus for filling a medicine bottle with medicines contained in a tablet case by a quantity designated by a prescription in a hospital, a dispensing pharmacy or the like.

Heretofore, medicines prescribed by a doctor are supplied to a patient by use of a medicine supply apparatus in a hospital or a dispensing pharmacy. That is, in this type of medicine supply apparatus, medicines (tablets, capsules, etc.) having a quantity described in a prescription are discharged one by one from a tablet case via a discharge drum to fill a medicine bottle.

In this case, a plurality of horizontally juxtaposed tablet cases are vertically stacked in stages. The medicine bottle is moved along the backside of the cases, conveyed to a predetermined tablet case, and filled with the medicines discharged from the tablet case (see U.S. Pat. Nos. 6,085,938 and 6,592,005).

As described above, in the medicine supply apparatus which fills the medicine bottle with the medicines, heretofore the system has been adopted in which a plurality of horizontally juxtaposed tablet cases are stacked in a plurality of stages, and the medicines are obliquely discharged rearwards to drop downwards. This causes a disadvantage that the discharged medicines are caught by a chute. In the medicine supply apparatus in which 200 or more necessary tablet cases are usually disposed, a height dimension is obliged to be increased. As a result, there is a problem that an installation space is partitioned, and the apparatus has to be disposed along the wall face.

Moreover, the plurality of horizontally juxtaposed tablet cases are vertically stacked in the plurality of stages, and the medicine bottles are vertically and horizontally moved on the rear side, conveyed to a predetermined tablet case, and filled with the medicines discharged from the tablet case.

That is, heretofore, in the medicine supply apparatus which fills the medicine bottles with the medicines, the plurality of horizontally disposed tablet cases are stacked in the plurality of stages, and the medicine bottles are vertically and horizontally moved, filled, and provided. Therefore, the apparatus has a problem that a constitution of a conveying device which conveys the medicines is complicated, and costs suddenly rise.

Moreover, in the medicine supply apparatus which fills the medicine bottle with the medicines, it is necessary to attach, to the outside of the medicine bottle, a label on which there are printed a name of a person to be provided, such as a patient, a medicine name, administration and the like. Heretofore, this label has been manually attached, or the medicine bottle has been fed into a label printing device to automatically attach the label to the bottle. In any case, an operation to handle the medicine bottle is increased, and the operation is laborious.

SUMMARY OF THE INVENTION

The present invention has been developed to solve such conventional technical problem, and an object thereof is to improve a medicine filling performance and remove restrictions regarding a medicine supply apparatus which fills medicine bottles with medicines from a plurality of tablet cases.

According to a first aspect of the present invention, a medicine supply apparatus which fills a medicine bottle with a medicine comprises: a plurality of tablet cases which contain the medicines and into which the medicines can be thrown from above; a case storage section in which the respective tablet cases are juxtaposed in one stage on a plane and whose top is openably closed; and filling means which is disposed under this case storage section and which fills the medicine bottle with the medicine dropping from each tablet case.

In the medicine supply apparatus of a second aspect of the present invention, the filling means comprises: medicine bottle holding means for holding the medicine bottle; and conveyance means for moving this medicine bottle holding means in a horizontal direction to dispose the medicine bottle under the predetermined tablet case.

In a third aspect of the present invention, the medicine supply apparatus further comprises: discharge means for dropping the medicine from each tablet case, and the medicine bottle holding means comprises: driving means for driving the discharge means; raising and lowering means for vertically moving this driving means to disengageably engage the driving means with the discharge means; and medicine detecting means for detecting the medicine dropping from each tablet case.

In a fourth aspect of the present invention, the medicine supply apparatus further comprises: label attaching means for attaching a label to the medicine bottle filled with the medicine by the filling means; lid closing means for closing the medicine bottle filled with the medicine with a lid; and providing means for conveying the medicine bottle provided with the label and closed with the lid to a predetermined position for each person to be provided.

In a fifth aspect of the present invention, the medicine supply apparatus of each of the above-described inventions further comprises: detecting means for detecting the presence of the tablet case.

In the first aspect of the present invention, the medicine supply apparatus which fills the medicine bottle with the medicine comprises: the plurality of tablet cases which contain the medicines and into which the medicines are thrown from above; a case storage section in which the respective tablet cases are juxtaposed in one stage on a plane and whose top is openably closed; and the filling means which is disposed under this case storage section and which fills the medicine bottle with the medicine dropping from each tablet case. Therefore, even when a large number of tablet cases are attached, a height dimension of the case storage section can be reduced. Accordingly, even when the medicine supply apparatus is disposed in a place other than a wall surface of an installation place, any space is not defined, and a degree of freedom in installation can be improved.

Moreover, the case storage section can be opened, and each tablet case can be replenished with the medicine from above. Therefore, it is possible to replenish, with the medicine, the tablet case attached to the case storage section without being removed. It is also possible to fill the medicine bottle with the medicine simultaneously with the replenishment of the tablet case with the medicine. Furthermore, in a case where the medicine supply apparatus is disposed in an installation place other than a place along the wall surface, the tablet case can be replenished with the medicines from multiple directions. Therefore, usability is remarkably improved in general.

Furthermore, in the second aspect of the present invention, the filling means comprises: the medicine bottle holding means for holding the medicine bottle; and the conveyance means for moving this medicine bottle holding means in the horizontal direction to dispose the medicine bottle under the predetermined tablet case. Therefore, the filling means can smoothly move the medicine bottle under the tablet case in a lower part of the case storage section to fill the medicine bottle with the medicine. Especially, since the medicine bottle holding means moves in the horizontal direction, there is little danger that the medicine is spilt from the medicine bottle being moved.

Additionally, in the third aspect of the present invention, the apparatus further comprises: the discharge means for dropping the medicine from each tablet case, and the medicine bottle holding means comprises: the driving means for driving the discharge means; the raising and lowering means for vertically moving this driving means to disengageably engage the driving means with the discharge means; and the medicine detecting means for detecting the medicine dropping from the tablet case. Therefore, it is possible to integrate the driving means and the raising and lowering means for discharging the medicine from the tablet case and moving the medicine bottle, and the medicine detecting means for detecting the medicine on the side of the medicine bottle holding means of the filling means. Accordingly, it is possible to remarkably reduce components and costs as compared with a case where each tablet case is provided with the driving means or the medicine detecting means.

Moreover, in the fourth aspect of the present invention, the apparatus of each of the above-described inventions further comprises: the label attaching means for attaching the label to the medicine bottle filled with the medicine by the filling means; the lid closing means for closing the medicine bottle filled with the medicine with the lid; and the providing means for conveying the medicine bottle provided with the label and closed with the lid to a predetermined position for each person whose is to be provided. Therefore, the label is attached to the medicine bottle filled with the medicine by the filling means, and the lid is closed without any trouble, so that the medicine can be provided to the person to be provided.

Furthermore, in the fifth aspect of the present invention, the apparatus of each of the above-described inventions further comprises: the detecting means for detecting the presence of the tablet case. In consequence, it is possible to save a useless control operation such as the moving of the medicine bottle to a position which is not provided with any tablet case, and it is possible to reduce a filling time.

Additionally, an object of the present invention is to realize conveying of a medicine bottle in an operation including filling with a medicine and providing of the medicine with a constitution which is as simple as possible in a medicine supply apparatus which fills the medicine bottles with the medicines from a plurality of tablet cases.

According to a sixth aspect of the present invention, a medicine supply apparatus fills a medicine bottle with a medicine, and comprises: a plurality of tablet cases which contain the medicines; filling means for filling the medicine bottle with the medicine discharged from each tablet case; and providing means for closing the medicine bottle filled with the medicine with a lid and conveying the medicine bottle to a predetermined position to provide the medicine bottle, the filling means comprising: filling medicine bottle holding means for holding the medicine bottle; and filling conveyance means for moving this filling medicine bottle holding means, the providing means comprising: a medicine bottle storage section in which an empty medicine bottle is stored; providing medicine bottle holding means for holding the medicine bottle; and providing conveyance means for moving the providing medicine bottle holding means, the filling means and the providing means receiving and transferring the medicine bottle via a predetermined transfer base.

In the medicine supply apparatus of a seventh aspect of the present invention, the providing means holds the empty medicine bottle of the medicine bottle storage section by means of the providing medicine bottle holding means, and moves the providing medicine bottle holding means to the transfer base by means of the providing conveyance means to dispose the empty medicine bottle on the transfer base. The filling means holds the empty medicine bottle on the transfer base by means of the filling medicine bottle holding means, moves the filling medicine bottle holding means by means of the filling conveyance means to fill the medicine bottle with the medicine discharged from the tablet case, and moves again the filling medicine bottle holding means to the transfer base to dispose the filled medicine bottle on the transfer base, and the providing means holds the filled medicine bottle on the transfer base by means of the providing medicine bottle holding means to convey the medicine bottle to a predetermined position.

In an eighth aspect of the present invention, the medicine supply apparatus further comprises: height adjusting means for adjusting a height of the transfer base in the sixth or seventh aspect of the present invention.

In the medicine supply apparatus of a ninth aspect of the present invention, the providing means comprises a plurality of medicine bottle storage sections detachably provided with medicine bottle units containing empty medicine bottles having different dimensions in the sixth to eighth aspects of the present invention.

In the medicine supply apparatus of a tenth aspect of the present invention, the providing means conveys the filled medicine bottle to a predetermined providing position distinguished for each person to be provided to provide the medicine bottle.

In the sixth aspect of the present invention, the medicine supply apparatus which fills the medicine bottle with the medicine comprises: the plurality of tablet cases which contain the medicines; the filling means for filling the medicine bottle with the medicine discharged from each tablet case; and the providing means for closing the medicine bottle filled with the medicine with the lid and conveying the medicine bottle to the predetermined position to provide the medicine bottle. The filling means comprises: the filling medicine bottle holding means for holding the medicine bottle; and the filling conveyance means for moving this filling medicine bottle holding means. The providing means comprises: the medicine bottle storage section in which the empty medicine bottle is stored; the providing medicine bottle holding means for holding the medicine bottle; and the providing conveyance means for moving the providing medicine bottle holding means. Moreover, the filling means and the providing means receive and transfer the medicine bottle via a predetermined transfer base. Therefore, a constitution of each conveyance means can be simplified even in a case where a conveying direction of the medicine bottle differs between the filling means and the providing means.

Moreover, it is possible to convey the medicine bottles by means of the respective conveying means simultaneously. Consequently, it is possible to supply the medicine quickly.

Especially as in the seventh aspect of the present invention, the providing means holds the empty medicine bottle of the medicine bottle storage section by means of the providing medicine bottle holding means, and moves the providing medicine bottle holding means to the transfer base by means of the providing conveyance means to dispose the empty medicine bottle on the transfer base. The filling means holds the empty medicine bottle on the transfer base by means of the filling medicine bottle holding means, moves the filling medicine bottle holding means by means of the filling conveyance means to fill the medicine bottle with the medicine discharged from the tablet case, and moves again the filling medicine bottle holding means to the transfer base to dispose the filled medicine bottle on the transfer base, and the providing means holds the filled medicine bottle on the transfer base by means of the providing medicine bottle holding means to convey the medicine bottle to the predetermined position. In consequence, it is possible to smoothly convey and transfer the medicine bottle.

Moreover, as in the eighth aspect of the present invention, there is disposed the height adjusting means for adjusting the height of the transfer base. In this case, even when the medicine bottles having different heights are used, each holding means holds the medicine bottle in the predetermined holding position, and the subsequent conveying and filling with the medicine can be smoothly performed.

Furthermore, according to the ninth aspect of the present invention, in addition to the inventions of the sixth to eighth aspects, the providing means comprises a plurality of the medicine bottle storage sections detachably provided with medicine bottle units containing empty medicine bottles having different dimensions. Therefore, it is possible to freely select and attach the medicine bottle unit for use depending on the dimension of the medicine bottle for use, and convenience is improved.

In addition, according to the tenth aspect of the present invention, in addition to the inventions of the sixth to ninth aspects, the providing means conveys the filled medicine bottle to the predetermined providing position distinguished for each person to be provided to provide the medicine bottle. Therefore, the filled medicine bottle can be easily found, and quickly provided to the person to be provided. Moreover, erroneous providing can be prevented.

Moreover, an object of the present invention is to simplify a structure for automatically attaching a label to a medicine bottle in a medicine supply apparatus which fills the medicine bottles with medicines from a plurality of tablet cases.

According to an eleventh aspect of the present invention, a medicine supply apparatus fills a medicine bottle with a medicine discharged from a tablet case, and comprises: discharge means for discharging the medicine from the tablet case; label attaching means for printing a label to be attached to the medicine bottle to provide the label to a predetermined label attaching position; and filling means for filling the medicine bottle with the medicine discharged from the tablet case, this filling means comprising: medicine bottle holding means for holding the medicine bottle by means of a holding roller; conveyance means for moving this medicine bottle holding means to dispose the medicine bottle under the tablet case and in the label attaching position; and driving means, the driving means driving the discharge means, when the medicine bottle is positioned under the tablet case, the driving means rotating the medicine bottle to attach the label to the medicine bottle, when the medicine bottle is disposed in the label attaching position.

In a twelfth aspect of the present invention, the medicine supply apparatus comprises a driving gear and a driving roller which are disposed on a driving shaft of the driving means, the filling means engaging the driving gear with the discharge means to drive the discharge means in a state in which the driving roller is detached from the medicine bottle, when the medicine bottle is positioned under the tablet case, the filling means bringing the driving roller into contact with an outer face of the medicine bottle to rotate the medicine bottle, when the medicine bottle is disposed in the label attaching position.

In the medicine supply apparatus of a thirteenth aspect of the present invention, the medicine bottle holding means comprises a pair of holding arms which are brought close to and detached from each other, each holding arm comprises a pair of holding rollers, and the respective holding arms are brought close to each other to rotatably hold the medicine bottle by means of each holding roller.

In the eleventh aspect of the present invention, the medicine supply apparatus which fills the medicine bottle with the medicine discharged from the tablet case comprises: the discharge means for discharging the medicine from the tablet case; the label attaching means for printing the label to be attached to the medicine bottle to provide the label to the predetermined label attaching position; and the filling means for filling the medicine bottle with the medicine discharged from the tablet case. This filling means comprises: the medicine bottle holding means for holding the medicine bottle by means of the holding roller; the conveyance means for moving this medicine bottle holding means to dispose the medicine bottle under the tablet case and in the label attaching position; and the driving means. The driving means drives the discharge means, when the medicine bottle is positioned under the tablet case. The driving means rotates the medicine bottle to attach the label to the medicine bottle, when the medicine bottle is disposed in the label attaching position. Therefore, it is possible to automate a series of operations including the filling of the medicine bottle with the medicine and the attaching of the label, and operability can be remarkably improved.

Moreover, it is possible to perform the driving of the discharge means for discharging the medicine from the tablet case and the rotating of the medicine bottle during the attaching of the label by means of the same driving means. Therefore, it is possible to reduce components and costs.

Especially, as in the twelfth aspect of the present invention, the apparatus comprises the driving gear and the driving roller which are disposed on the driving shaft of the driving means. The filling means engages the driving gear with the discharge means to drive the discharge means in the state in which the driving roller is detached from the medicine bottle, when the medicine bottle is positioned under the tablet case. Moreover, the filling means brings the driving roller into contact with the outer face of the medicine bottle to rotate the medicine bottle, when the medicine bottle is disposed in the label attaching position. In this case, it is possible to smoothly perform the discharging of the medicine and the rotating of the medicine bottle by means of the same driving means. Moreover, since the medicine bottle does not rotate during the discharging of the medicine, the medicine bottle does not move during the filling with the medicine even in a case where the outer face of the medicine bottle is tapered.

Furthermore as in the thirteenth aspect of the present invention, the medicine bottle holding means comprises a pair of holding arms which are brought close to and detached from each other, each holding arm comprises a pair of holding rollers, and the respective holding arms are brought close to each other to rotatably hold the medicine bottle by means of each holding roller. In this case, even when a position of the medicine bottle held by the medicine bottle holding means deviates, each holding roller abuts on the medicine bottle during the bringing of the respective holding arms close to each other, and the rotating holding rollers cooperate to guide the medicine bottle to the predetermined position. Therefore, in such case, the medicine bottle is positioned with good precision.

DETAILED DESCRIPTION OF THE PREFERRED EMBODIMENT

Figure 1:
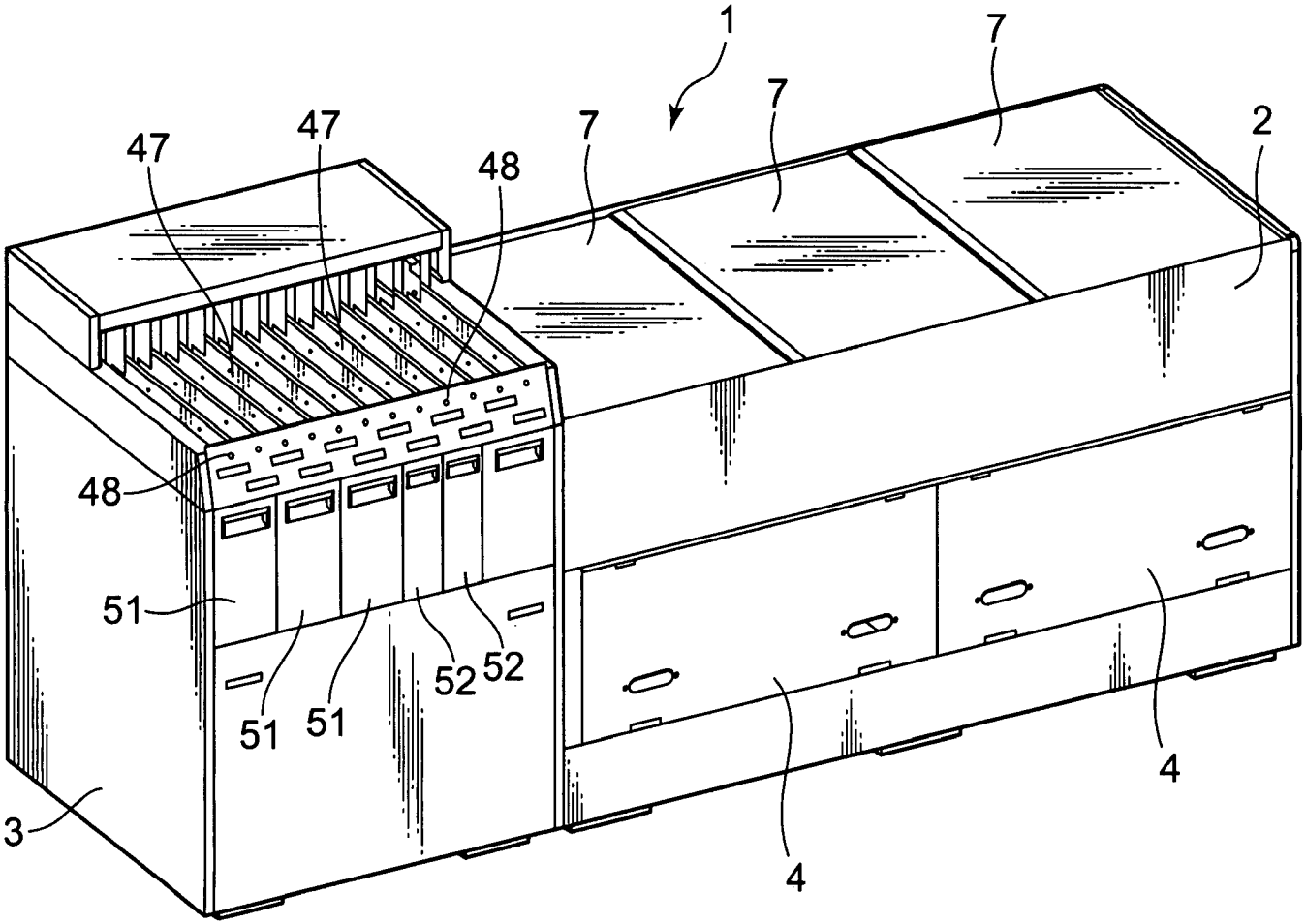
FIG. 1 is a perspective view of a medicine supply apparatus in an embodiment to which the present invention is applied.

There will be described hereinafter one embodiment of the present invention in detail with reference to the drawings.

In the embodiment, a medicine supply apparatus 1 is installed in a hospital, a dispensing pharmacy or the like to fill a medicine bottle with a medicine designated by a doctor's prescription and provide a person who is to be provided, such as a patient. The apparatus is generally constituted of: a charging unit 2 having a rectangular shape; and a providing unit 3 (providing means) similarly having a substantially rectangular shape and connected to the left of the charging unit 2 as one faces in a state in which the insides of the units communicate with each other.

(1) Charging Unit 2

First, a structure of the charging unit 2 will be described. A height dimension of the charging unit 2 is in a range of, for example, 900 mm to 1000 mm, and the unit is approximately as high as a usual table. A width of the unit is in a range of 1600 mm to 1700 mm, and a depth thereof is in a range of 800 mm to 900 mm. The front of this charging unit 2 is closed with openable panels 4, and a case containing section 6 is constituted in an upper part of the charging unit 2. The top of this case containing section 6 opens, and this upper opening is openably closed with top tables 7 which are removably disposed or one-side-rotatably supported. The top tables 7 have predetermined strengths so that articles (medicines contained in a carton case and the like) for use in the hospital or the dispensing pharmacy can be laid on the tables.

Figure 8:
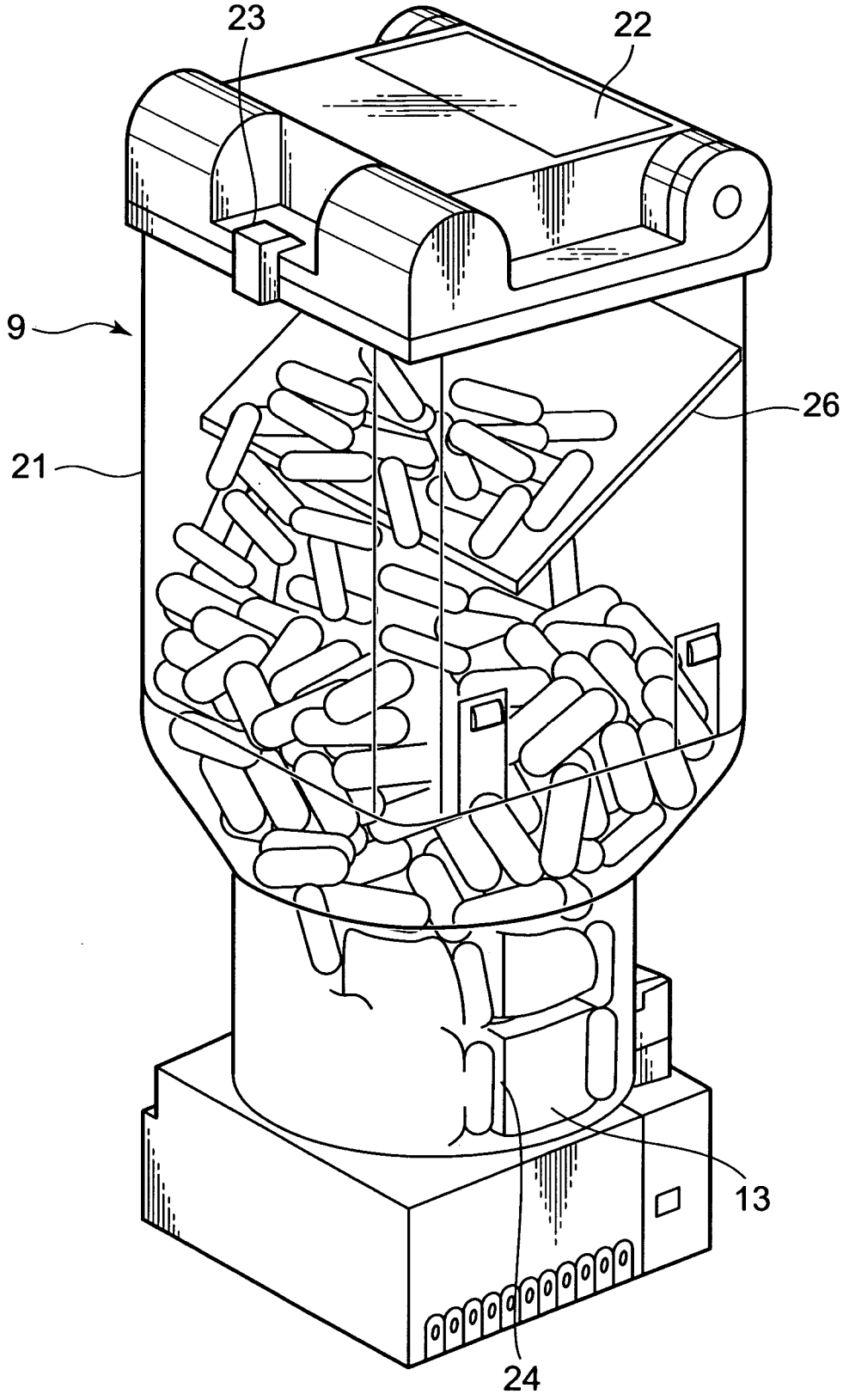
FIG. 8 is a perspective view of a tablet case.

An attaching plate 11 for attaching tablet cases 9 shown in FIG. 8 onto one plane is attached to the bottom of this case containing section 6. To this attaching plate 11, there are attached 200 attaching bases 12 shown in FIG. 11 for attaching one stage of 200 tablet cases 9 in total of 20 columns×10 rows. An engaging shaft 14 (constituting discharge means) is protruded from the top of each of the attaching bases 12 . . . to engage with a discharge drum 13 (discharge means) of the tablet case 9 described later. This engaging shaft 14 extends to the bottom of the attaching base 12, and an engagement gear 16 (constituting the discharge means) is attached to a lower end portion of the shaft.

Moreover, the attaching base 12 is provided with a chute 17 protruding right downwards and having a rectangular sectional shape, and upper and lower ends of the chute 17 open. Furthermore, each of the attaching bases 12 . . . is provided with a tablet case sensor 18 (shown in FIG. 20, detection means) for detecting whether or not the tablet case 9 is attached to the attaching base 12.

Figure 6:
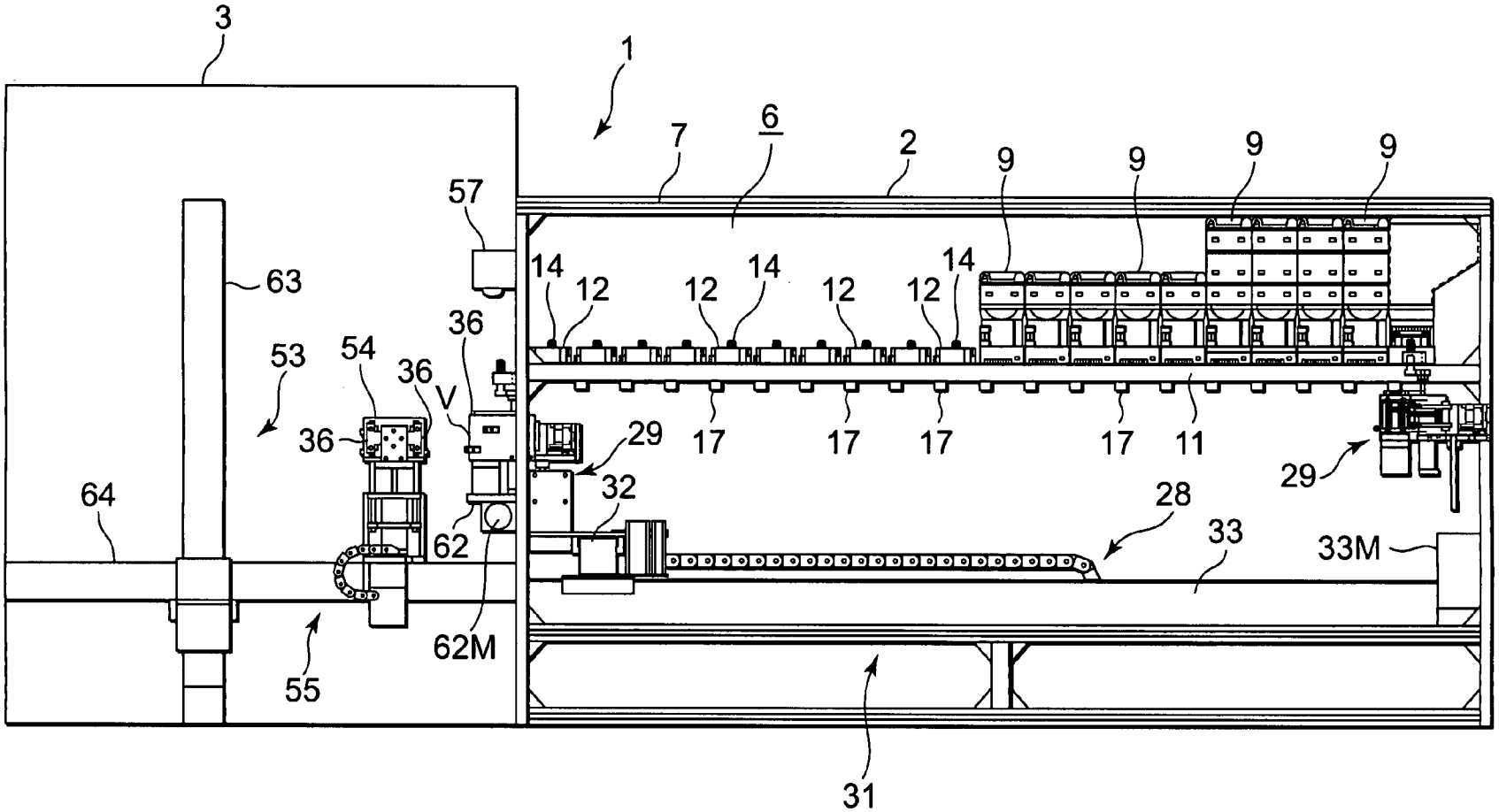
FIG. 6 is similarly a side view.
Figure 7:
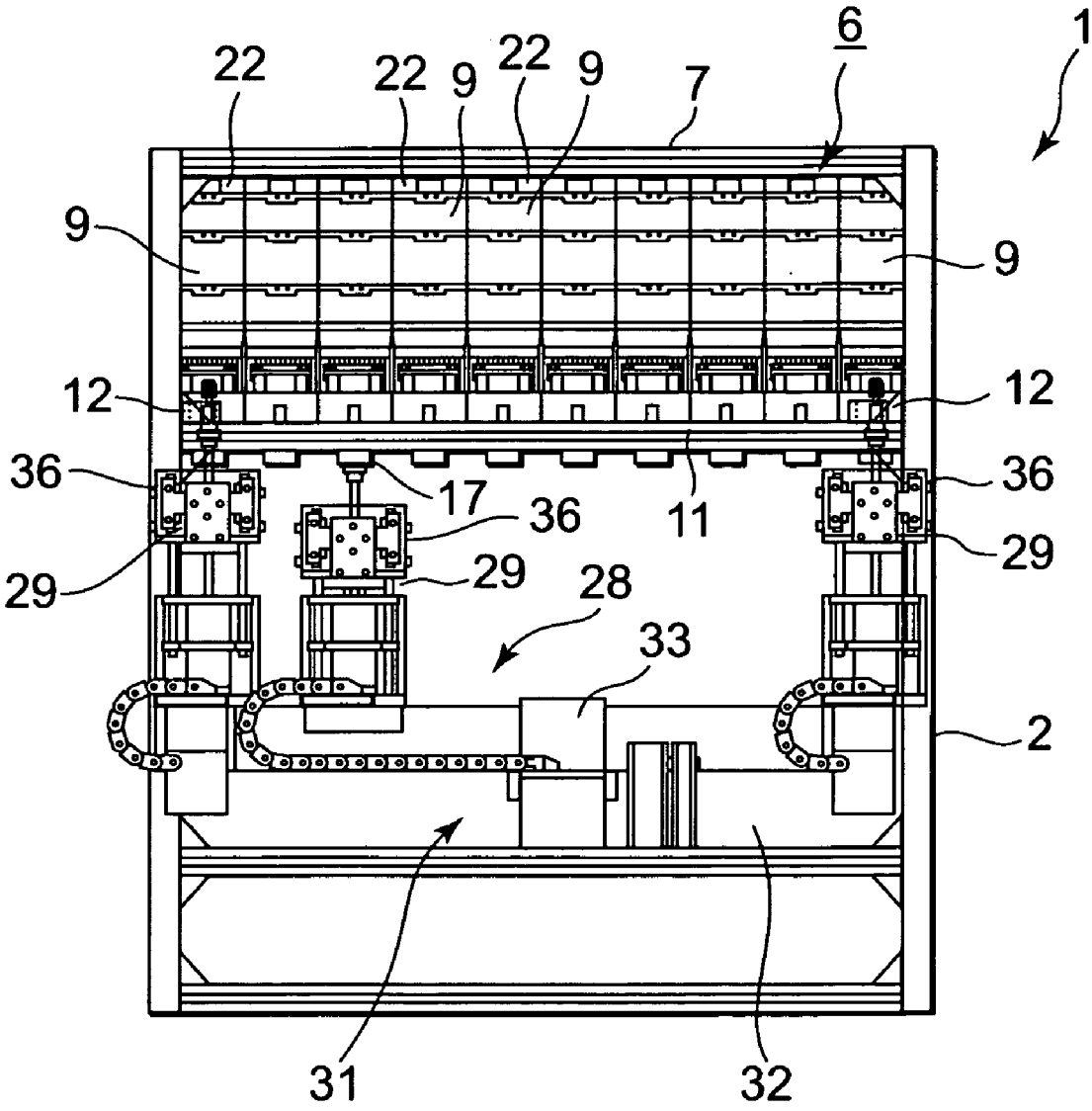
FIG. 7 is similarly an end view.

The tablet case 9 is constituted of a storage container 21 as shown in FIG. 8, and two types of storage containers 21, that is, short and long containers are prepared in the embodiment as shown in FIG. 6. Moreover, the height dimension of the case containing section 6 is set such that the tablet cases 9 constituted of the high storage containers 21 can be attached. The top of the storage container 21 opens, and this opening is openably closed with a lid 22 whose one side is rotatably supported. Accordingly, the medicine can be thrown and replenished into the storage container 21 of the tablet case 9 from above.

Moreover, a manual lock (locking mechanism) 23 for retaining the closed state of the lid 22 is disposed on an upper opening edge of the storage container 21 on a non-supported side of the lid 22. Accordingly, considerations are taken so as to prevent the lid 22 from being inadvertently opened, when the tablet case 9 is lifted up to be removed. In the bottom part of the storage container 21, the discharge drum 13 is attached via which the medicines drop downwards one by one. A plurality of vertical grooves 24 are formed at predetermined intervals in a side periphery of this discharge drum 13. When the lock 23 is unlocked, and the lid 22 is opened to throw/charge the medicine via the upper opening of the storage container 21, the medicine enters the vertical groove 24 of the discharge drum 13. Moreover, the discharge drum 13 is rotated as described later to match the vertical groove 24 with a portion of the attaching base 12 above the chute 17, the contained medicines naturally drops into the chute 17 one by one.

In this case, in a substantially intermediate height position of the storage container 21 in a vertical direction, a partition member 26 is attached which obliquely tilts downwards from one wall (on the supported side of the lid 22 in the embodiment) toward the other wall. A tip of this partition member 26 faces the other wall with a gap capable of passing the medicine. Accordingly, the inside of the storage container 21 is vertically partitioned in a state in which the medicine thrown from the upper opening is allowed to pass downwards from the partition member 26 to the discharge drum 13 via the tip of the member.

Here, especially in the long tablet case 9 of the storage container 21, since the quantity of the contained medicine is large, a large load is applied to the discharge drum 13, and such load of the medicine generates a trouble in the rotation of the discharge drum 13. The discharge drum 13 which is to rotate thrusts upwards hard. However, when the inside of the storage container 21 is vertically partitioned by the partition member 26 in this manner, most of the load applied by the medicine above is received by the partition member 26. Therefore, the load applied to the discharge drum 13 is reduced, a rotation defect (medicine discharge defect) is prevented from being generated, and the thrust-up can be reduced.

Moreover, to attach such tablet case 9 to the attaching base 12, the top table 7 is opened, and the tablet case is detachably attached to the attaching base 12 from above. In this case, the upper end portion of the engaging shaft 14 of the attaching base 12 engages with the discharge drum 13 from below, and the rotating force is transmitted to the discharge drum 13. The tablet case sensor 18 turns on when the tablet case 9 is attached to the sensor, and turns off when the case is not attached. To replenish the storage container 21 with the medicine, the top table 7 is similarly opened to unlock the lock 23 of the tablet case 9, and the lid 22 is opened to charge the medicine into the storage container 21 from above. That is, according to such constitution, the medicine can be replenished in a state in which the tablet case 9 is attached to the attaching base 12. Therefore, the tablet case 9 can be replenished with the medicine while filling a medicine bottle V described later with the medicine.

Figure 9:
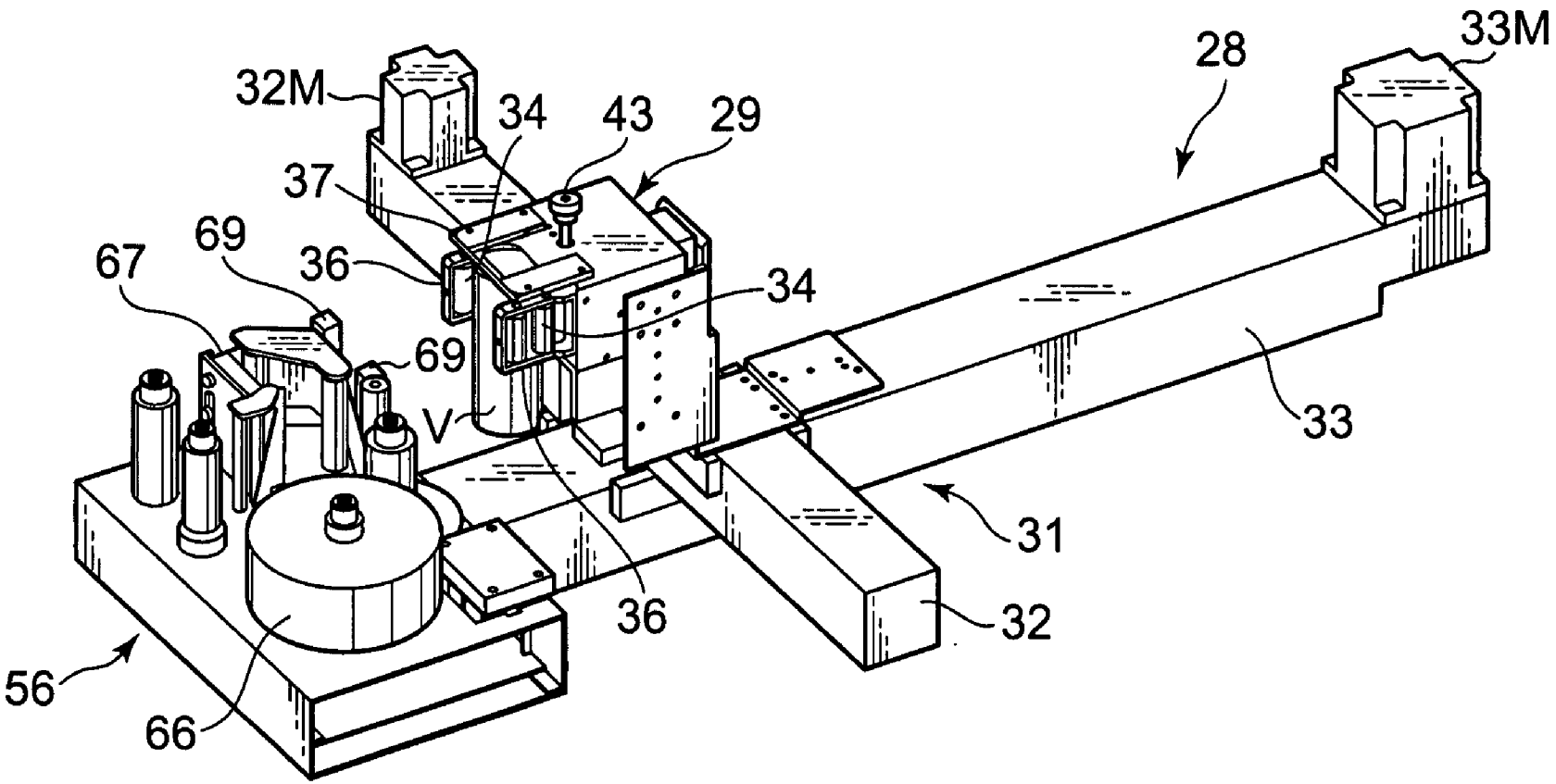
FIG. 9 is a perspective view showing a conveying device in a charging device and a label attaching device in a providing device.
Figure 10:
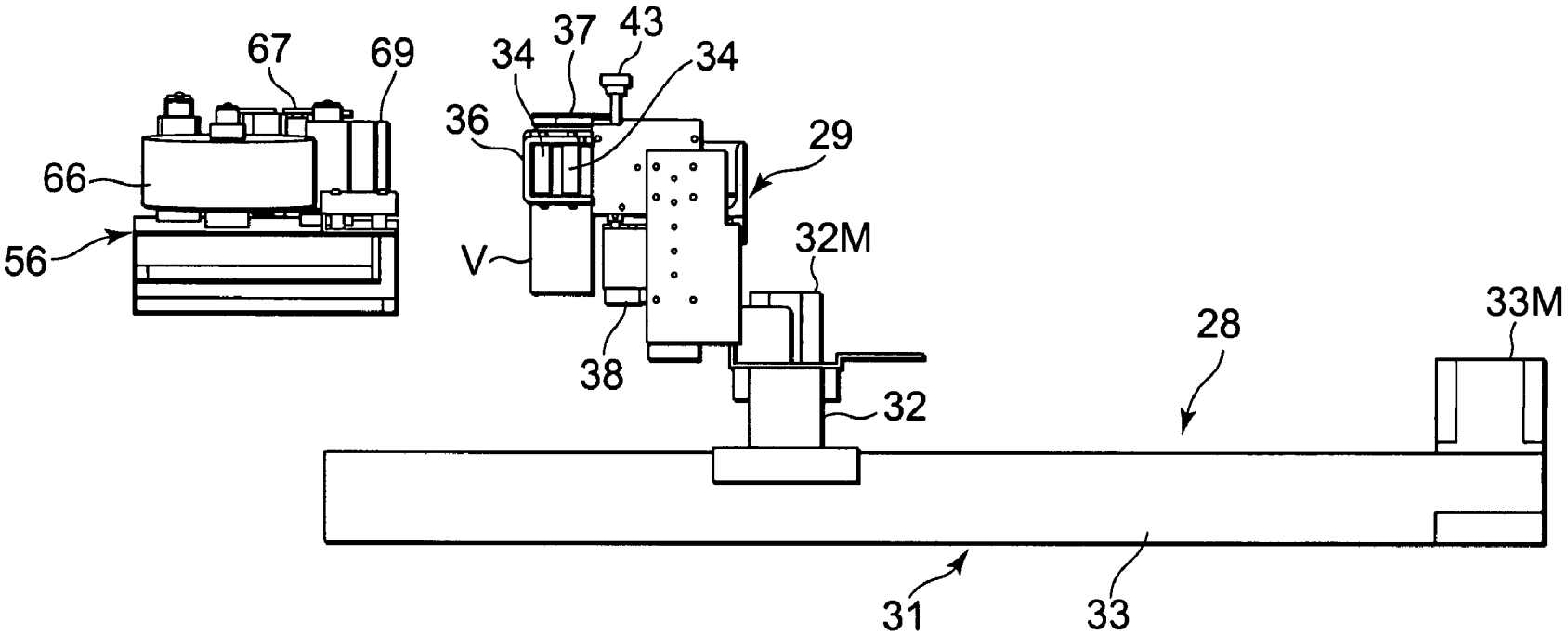
FIG. 10 is a front view of FIG. 9.

Furthermore, a charging device 28 (charging means) is disposed under the case containing section 6 in a lower part of the charging unit 2. This charging device 28 is constituted of: a holding device 29 (charging medicine bottle holding means) for holding the medicine bottle V; and a conveying device (charging conveyance means) 31 for conveying and disposing this holding device 29 and the medicine bottle V held by the device under the predetermined tablet case 9. As shown in FIGS. 9 and 10 in an extracted manner, this conveying device 31 is constituted of: a rail 32 horizontally disposed in a longitudinal direction (depth direction, X-axis); and a rail 33 for horizontally moving this rail 32 in a lateral direction (Y-axis), and motors 32M, 33M for conveyance are attached to end portions of the respective rails 32, 33. The motors 32M, 33M drive the rails to move the holding device 29 (medicine bottle V) along an X-Y axis in a horizontal direction under the tablet cases 9 . . . disposed in the case containing section 6. The holding device is disposed under the predetermined tablet case 9, and thereafter moved. It is to be noted that the motor 33M is positioned in an end portion of the lower part of the charging unit 2 on a side opposite to the providing unit 3. The tablet case 9 whose lateral size is twice that of the storage container 21 (doubled in the horizontal direction) (the lower end portion of the storage container 21 and the attaching base 12 are used in common) can be attached utilizing an installation space (dead space) of this motor 33M.

Figure 11:
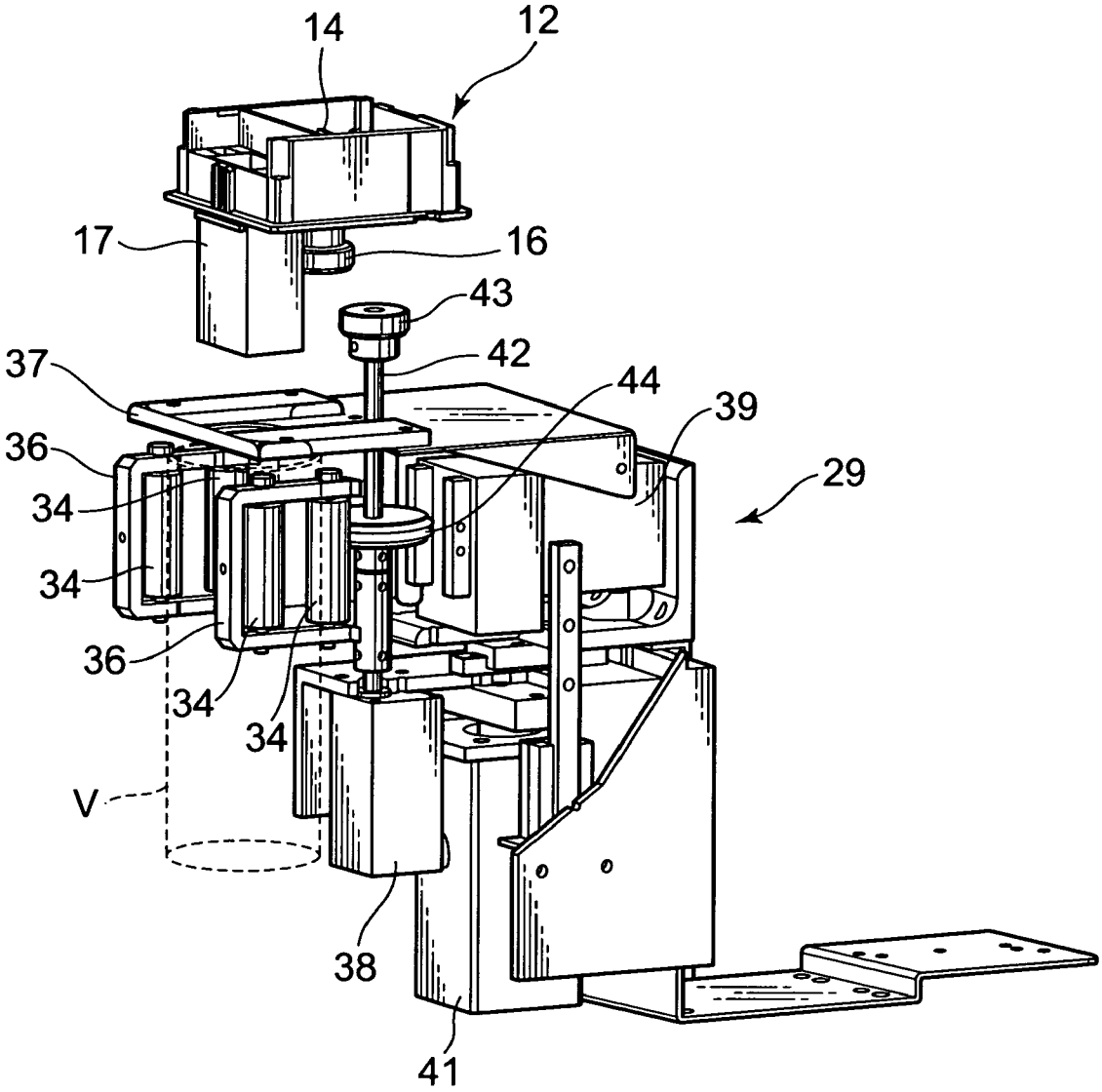
FIG. 11 is a perspective view showing a holding device and an attaching base in the conveying device of the charging device.
Figure 12:
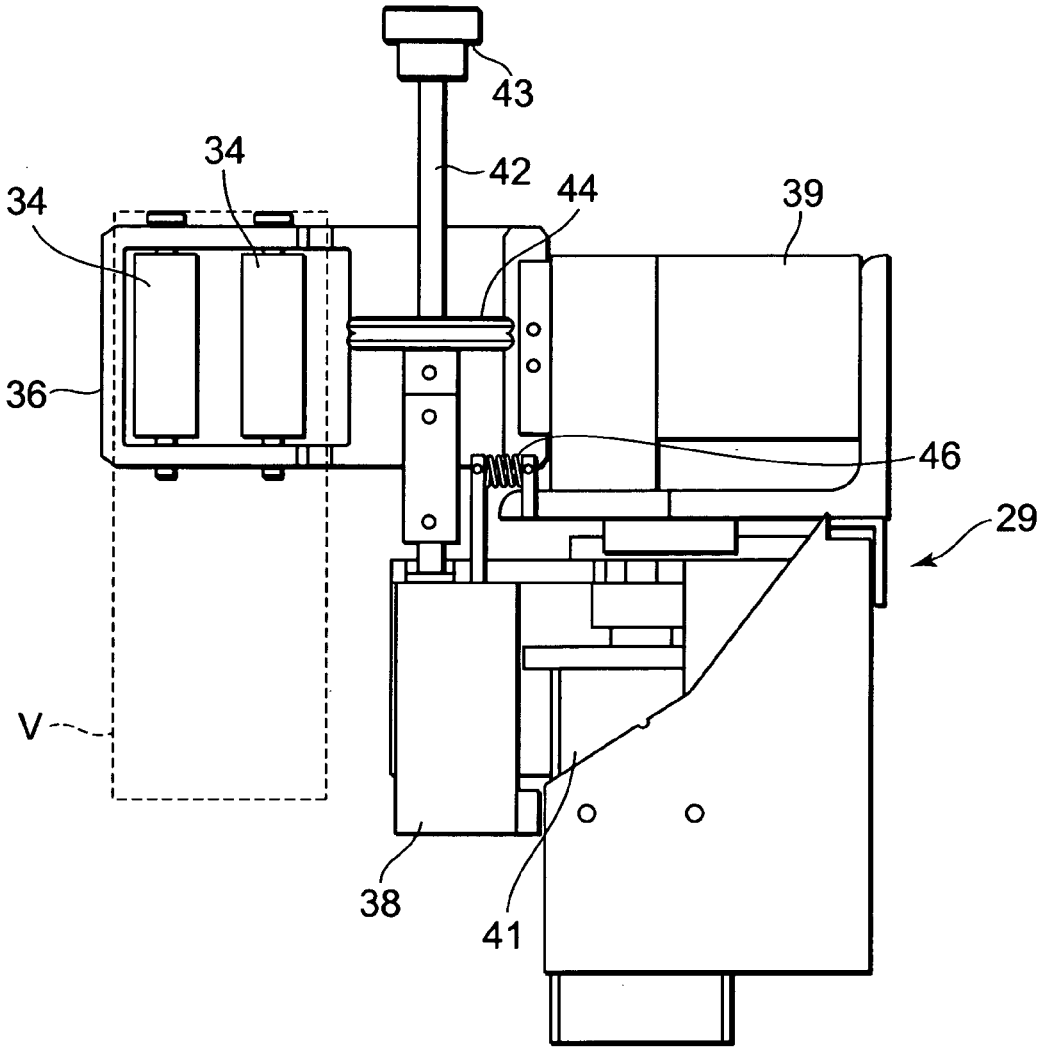
FIG. 12 is a front view of the holding device in the conveying device of the charging device.
Figure 13:
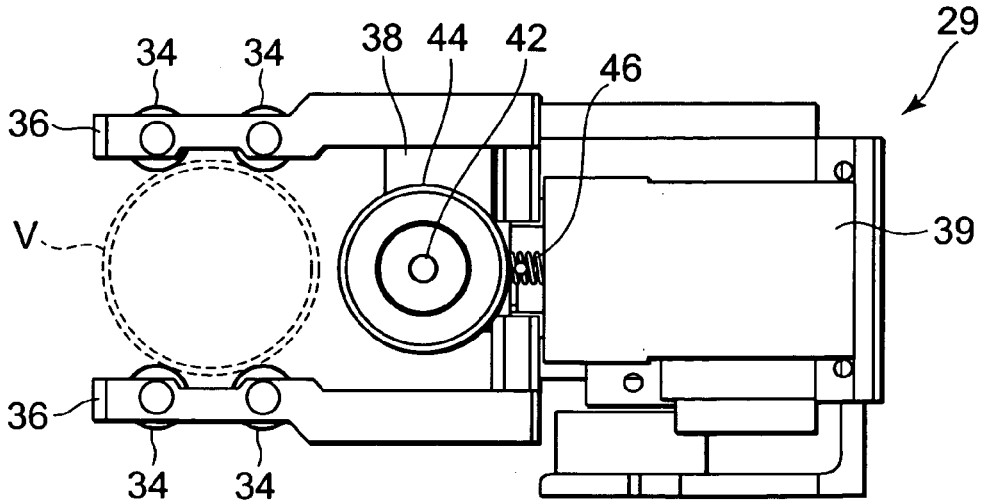
FIG. 13 is a plan view of the holding device of FIG. 12.

Moreover, the holding device 29 is shown in FIGS. 11 to 13. The holding device 29 is integrally constituted of: a pair of holding arms 36, 36 (tips are directed toward the providing unit 3) provided with a pair of holding rollers 34, 34 using a vertical direction as a rotary axis and disposed with a predetermined interval; a medicine detecting sensor (medicine detecting means) 37 (omitted from FIGS. 12 and 13) disposed above the holding arm 36; a rotating motor (driving means) 38 for rotating the discharge drum 13; a holding motor 39 for bringing the holding arms 36, 36 close to each other or detaching the arms from each other to hold or release the medicine bottle V; a raising and lowering motor (raising and lowering means) 41 for raising or lowering the holding arms 36, 36, the medicine detecting sensor 37, the rotating motor 38, and the holding motor 39.

The holding motor 39, for example, rotates forwards to bring the holding arms 36, 36 close to each other, and the medicine bottle V is held between the holding arms 36, 36. Moreover, the motor rotates in reverse to detach the holding arms 36, 36 from each other, thereby releasing the held medicine bottle V. In this case, the medicine bottle V is rotatably held by total of four holding rollers 34 . . . of the holding arms 36, 36 by use of a vertical direction as an axis. The holding arms 36, 36 hold the medicine bottle V in a predetermined holding position so that the upper opening of the medicine bottle V remarkably comes close to the medicine detecting sensor 37 under the sensor. Furthermore, a driving shaft 42 of the rotating motor 38 extends upwards from the vicinity of a base portion of the holding arms 36, 36, a driving gear 43 is attached to a tip of the driving shaft positioned highest in the holding device 29, and a driving roller 44 is attached to a portion of the driving shaft 42 between the base portions of the holding arms 36, 36.

Figure 17:
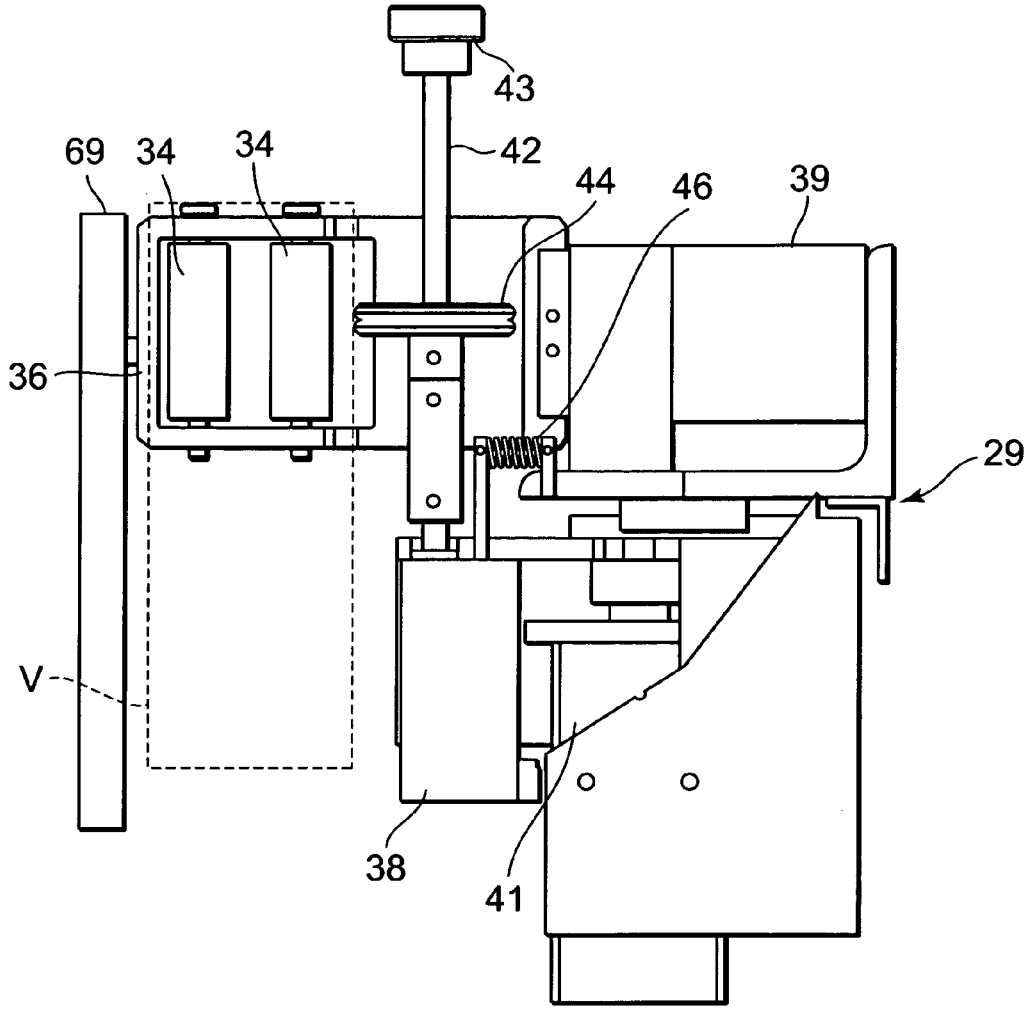
FIG. 17 is a front view of the holding device of the conveying device in the label attaching position.
Figure 18:
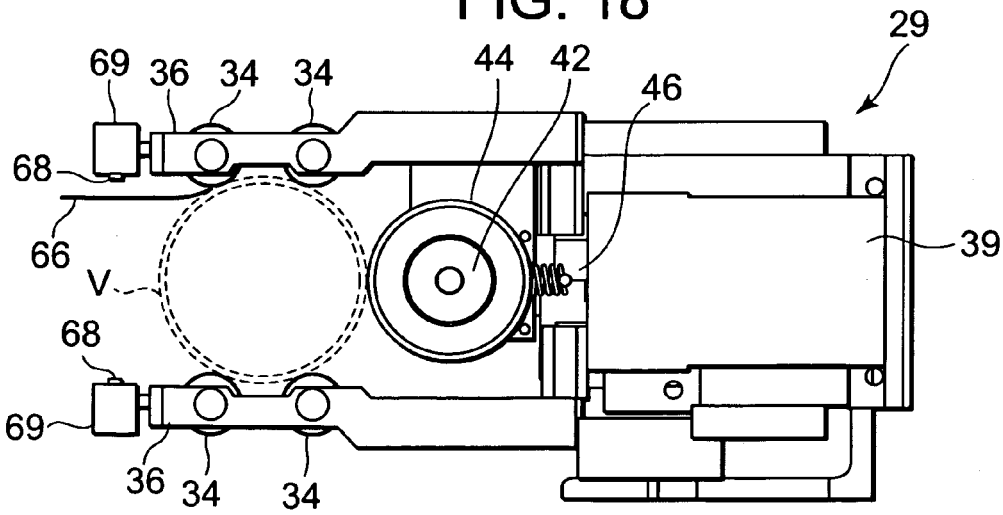
FIG. 18 is a plan view of the holding device of FIG. 17.
Figure 22:
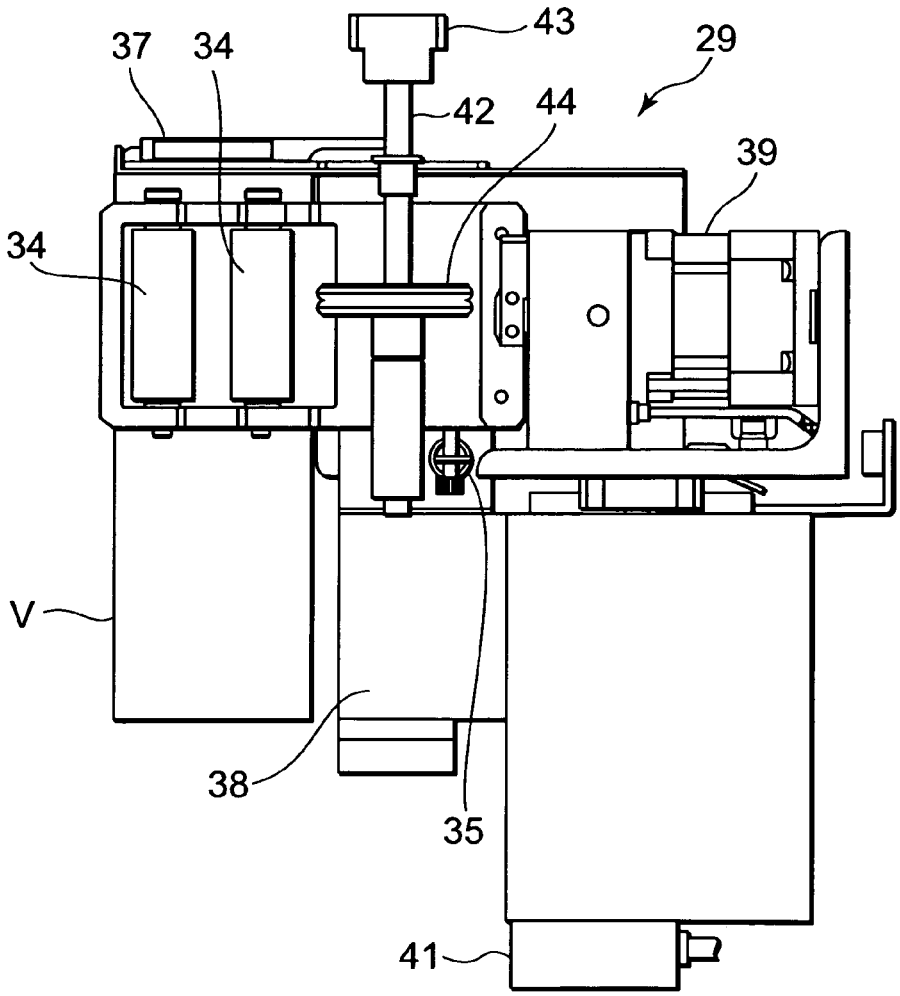
FIG. 22 is a front view showing another embodiment of the holding device of the conveying device in the charging device.
Figure 23:
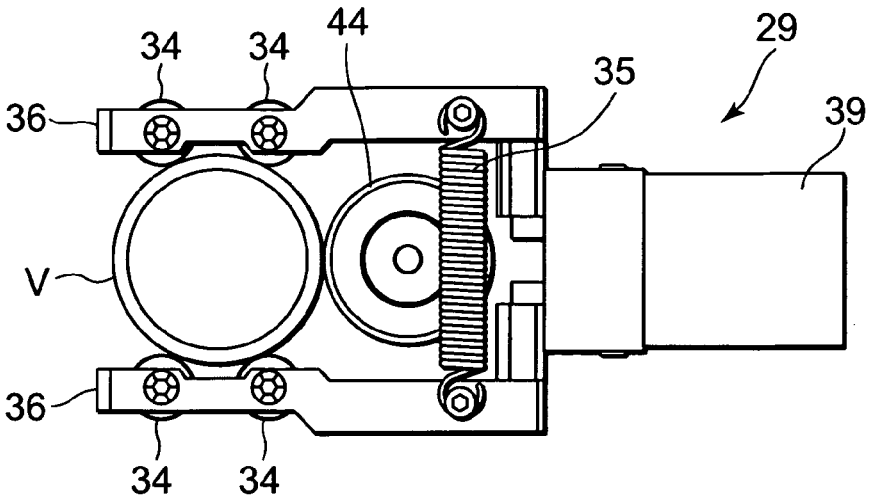
FIG. 23 is a plan view of the holding device of FIG. 22.
Figure 24:
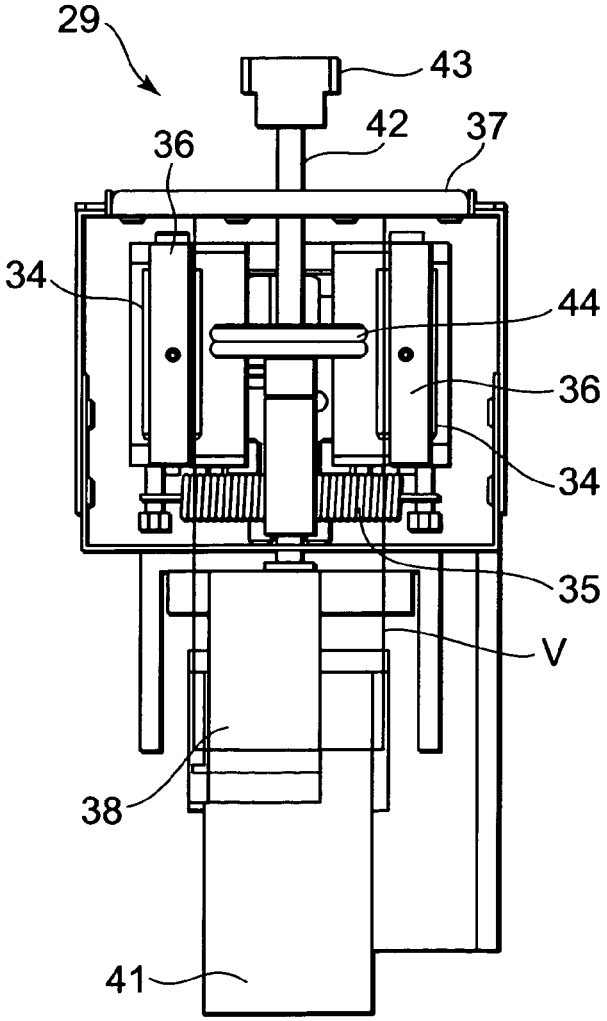
FIG. 24 is a side view of the holding device of FIG. 22.

Here, the holding arms 36, 36 and the holding motor 39 are movable in a direction (horizontal direction in FIG. 12) connecting the tips to the base portions of the holding arms 36, 36, and are constantly urged by a coil spring (urging means) 46 in a direction in which the medicine bottle V held by the holding arms 36, 36 is detached from the driving roller 44. Therefore, the medicine bottle V held by the holding arms 36, 36 does not constantly abut on the driving roller 44 (FIGS. 12, 13). However, when the holding arms 36, 36 and the holding motor 39 are moved toward the base portion of the holding arm 36 against the coil spring 46, the driving roller 44 abuts on the side of the medicine bottle V as shown in FIGS. 17, 18. The medicine bottle V is rotatably held between the holding rollers 34 . . . Therefore, in a case where the driving roller 44 is rotated while abutting on the side of the medicine bottle V, the bottle also rotates. It is to be noted that in addition to the above-described constitution, when a coil spring (urging means) 35 is disposed so as to constantly bring the holding arms 36, 36 close to each other as shown in FIGS. 22 to 24, the medicine bottle V is mechanically held between the holding arms 36, 36, and prevented from dropping even if power supply is cut off.

Figure 14:
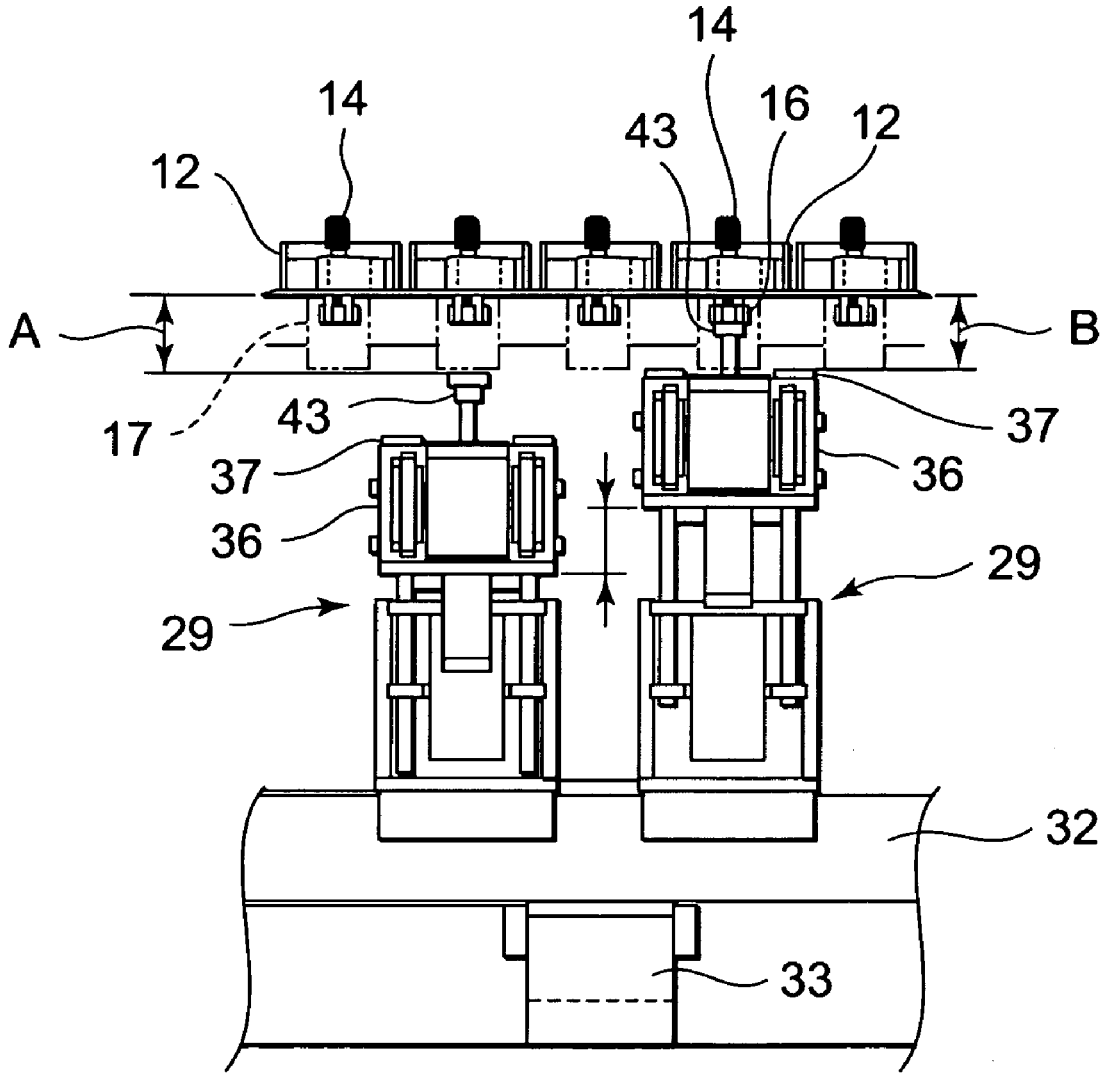
FIG. 14 is an explanatory view of an elevating/lowering operation of the holding device.
Figure 15:
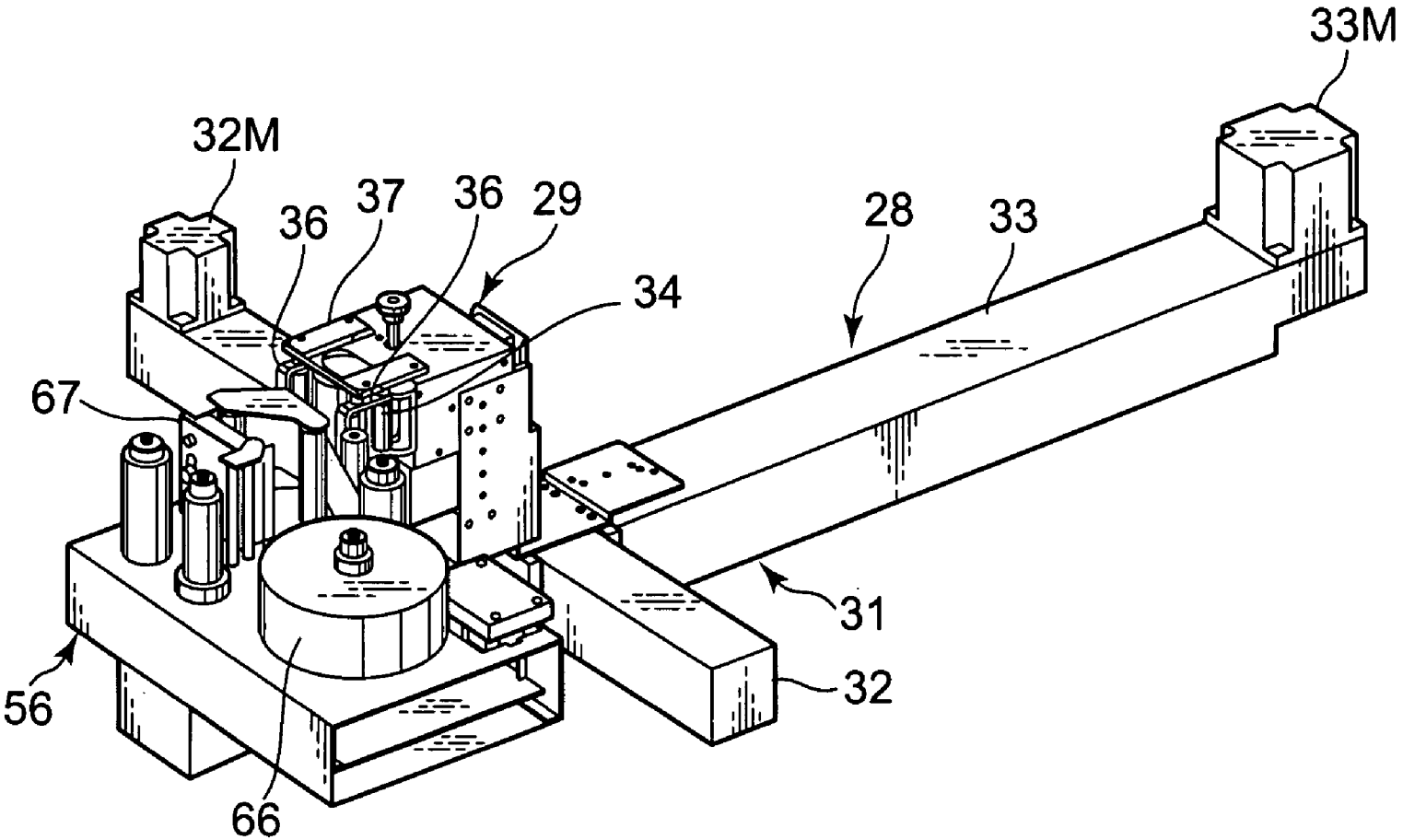
FIG. 15 is a perspective view showing the conveying device and the label attaching device ins the charging device disposed in a label attaching position.
Figure 16:
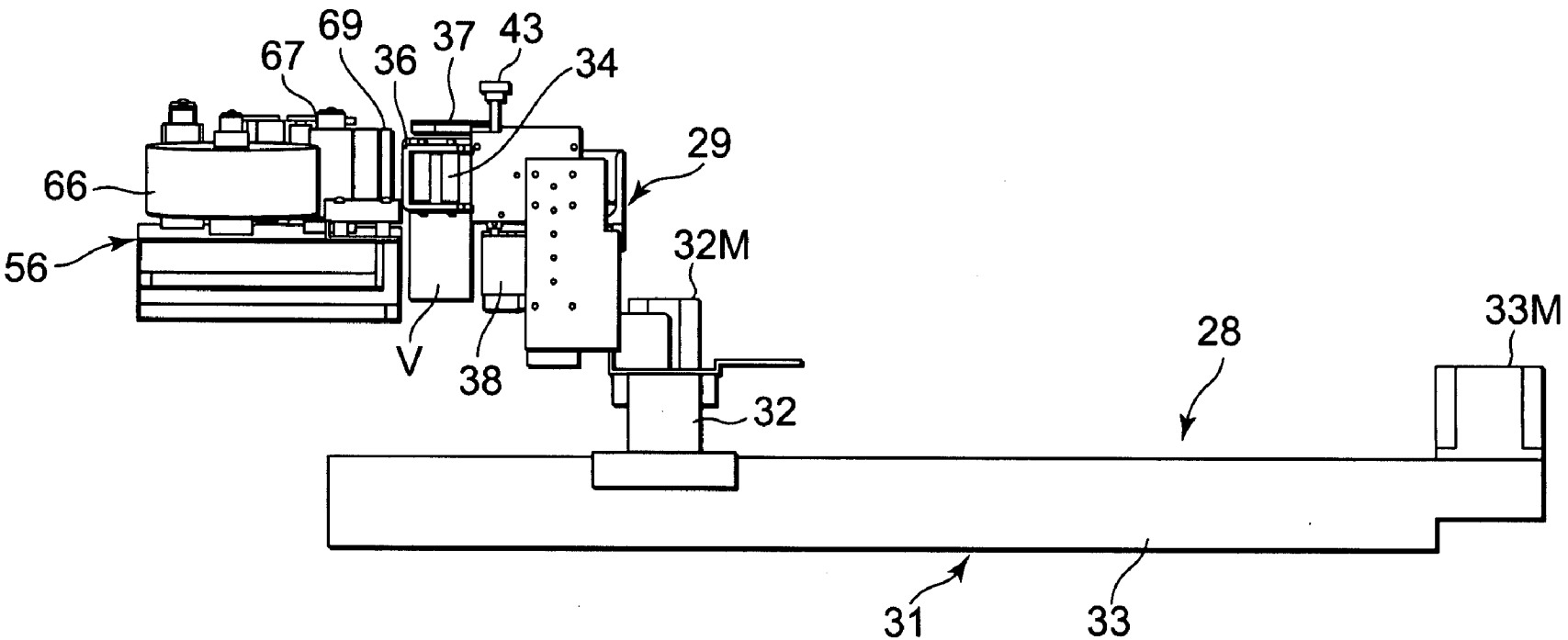
FIG. 16 is a front view of FIG. 15.
Figure 19:
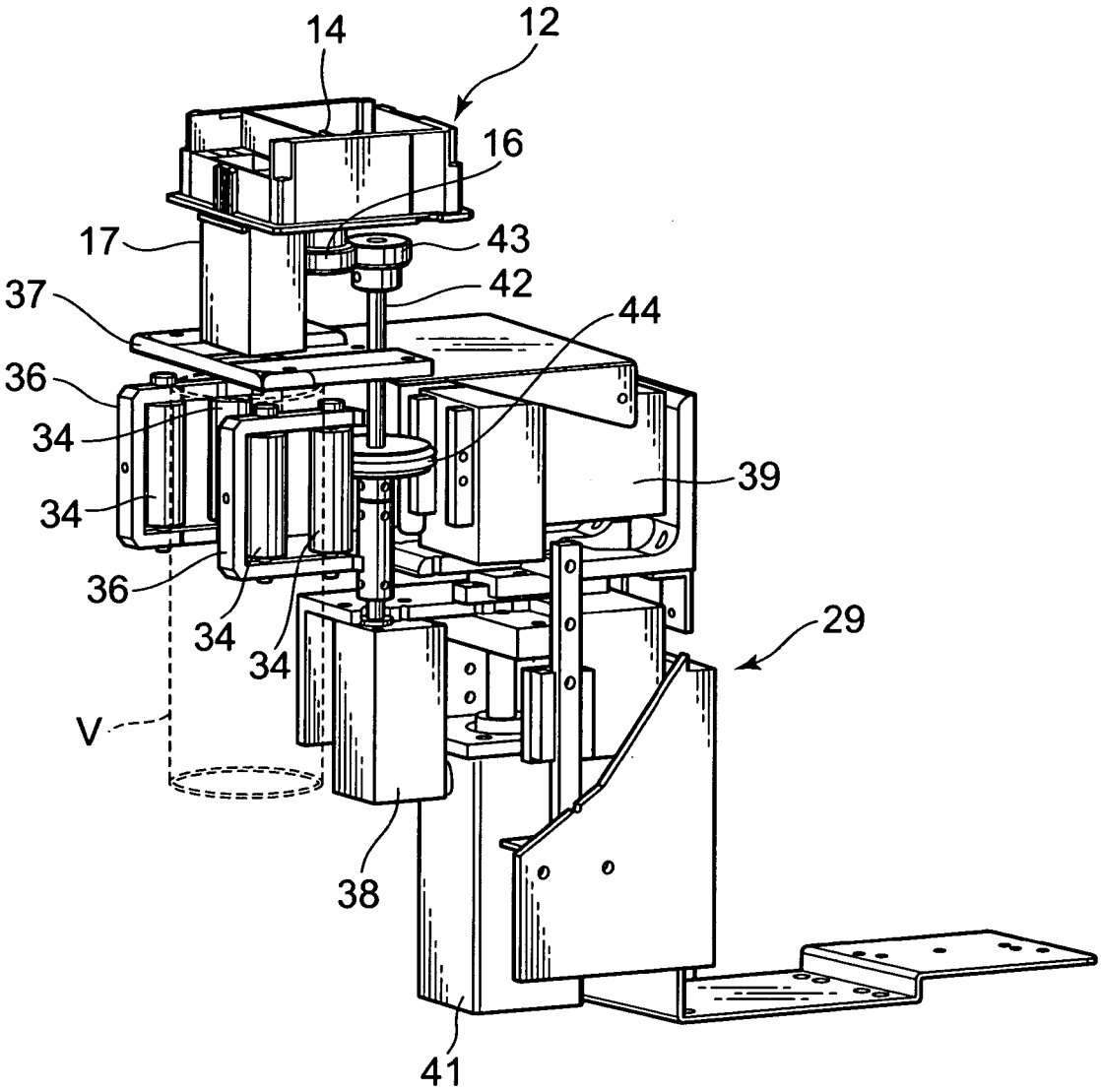
FIG. 19 is a perspective view of the holding device of FIG. 12 in a state in which holding arms rises.

Moreover, the raising and lowering motor 41, for example, rotates forward to raise the holding arms 36, 36, the medicine detecting sensor 37, the rotating motor 38, and the holding motor 39 (on the right side of FIG. 14, FIG. 19). The motor rotates in reverse to lower them (FIG. 11, on the left side of FIG. 14). The driving gear 43 positioned highest in this lowered state is disposed in a position which is lower than a lower end of the chute 17. Accordingly, the holding device 29 is movable in the horizontal direction under the chute 17 of each of the attaching bases 12 . . . without any trouble. When the holding device 29 is moved and disposed under the predetermined tablet case 9, the medicine bottle V faces the lower part of the chute 17. Moreover, when the raising and lowering motor 41 raises the holding arms 36, 36, the medicine detecting sensor 37, the rotating motor 38, and the holding motor 39 in this state, as shown in FIG. 19, the driving gear 43 disengageably engages the engagement gear 16 of the attaching base 12. Accordingly, when the rotating motor 38 is driven, the rotating force is transmitted to the driving gear 43, the engagement gear 16, the engaging shaft 14, and the discharge drum 13 to rotate the discharge drum 13, the medicines are discharged one by one into the chute 17, and drop into the medicine bottle V via the chute as described above.

In this case, assuming that a protruding dimension of the chute 17 is A, and a distance between the raised medicine detecting sensor 37 and the attaching base 12 is B as shown in FIG. 14, B (0.1 mm in the embodiment) is set to be slightly larger than A. In the raised state, the upper opening of the medicine bottle V comes close to the lower opening of the chute 17. Since the dimensions are set as described above, the medicine detecting sensor 37 is positioned externally in a height position between the openings of the bottle and the chute. This medicine detecting sensor 37 detects the medicine in an area including the whole areas of the openings of the chute 17 and the medicine bottle V, but the dimensions are set as described above. Therefore, the medicine detecting sensor 37 can detect the medicine in a position remarkably close to the openings of the medicine bottle V and the chute 17. The medicine detecting sensor 37 is positioned distant from the discharge drum 13 of the tablet case 9 by a dimension corresponding to at least the dimension of the chute 17. Therefore, it is possible to prevent or inhibit a disadvantage that dust, dirt or the like on the medicine bottle sticks to the medicine detecting sensor 37 to deteriorate a detecting precision.

(2) Providing Unit 3

Figure 4:
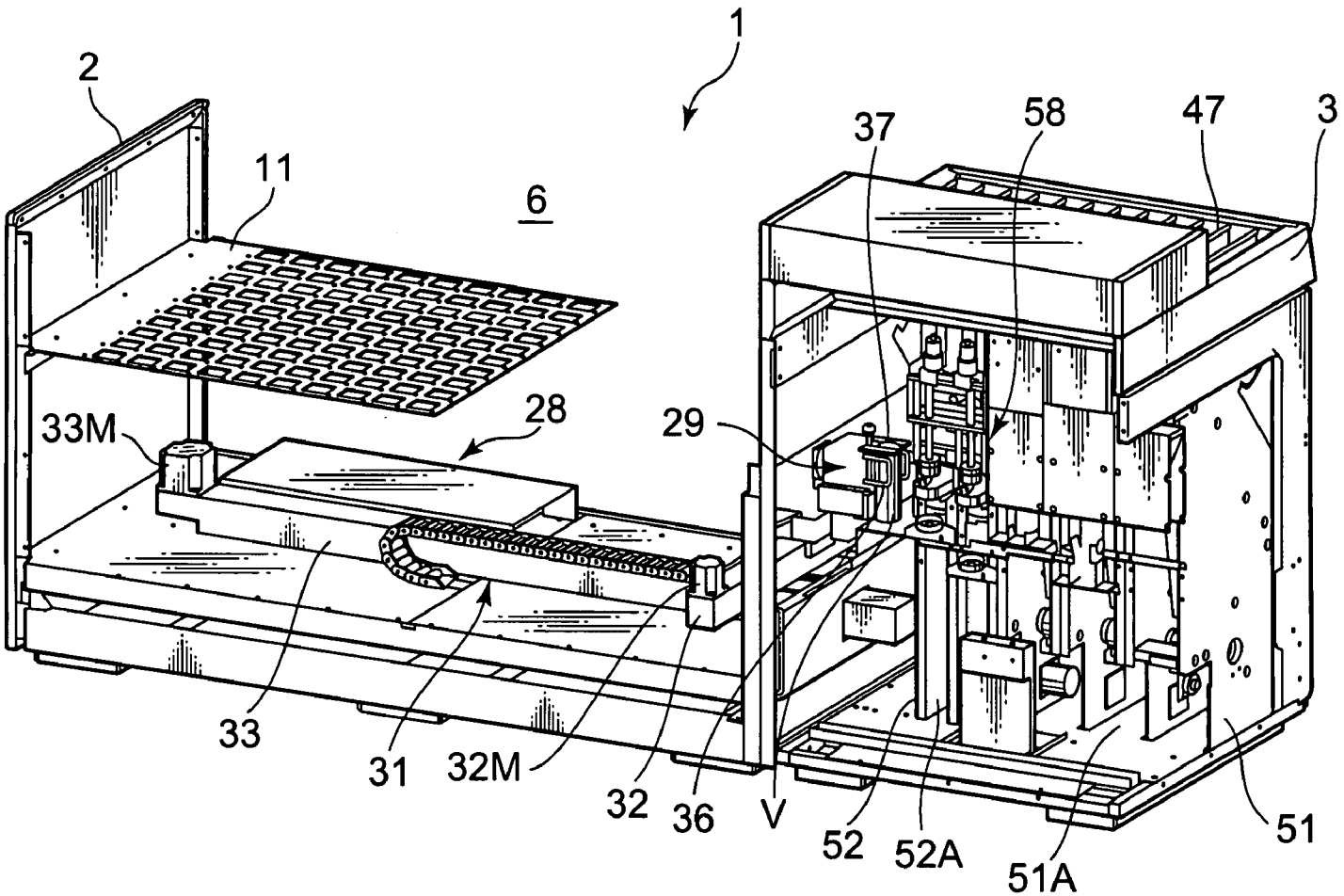
FIG. 4 is similarly a rear perspective view.

Next, a structure of the providing unit 3 will be described. An upper part of the providing unit 3 is provided with aligning conveyers 47 and providing displays 48 which align and provide the medicine bottle V filled with the medicine for each person who is to be provided. Inside the providing unit 3, there are arranged: three medicine bottle units (medicine bottle storage sections) 51 . . . which store a large number of empty medicine bottles V; two lid units 52, 52; a providing device constituted of a conveying device (providing conveyance means) 53 and a holder (providing medicine bottle holding means) 54; a label attaching device (label attaching means) 56; a photographing device (photographing means) 57; a lid closing device 58 (shown in FIGS. 4, 20); two transfer tables 61, 62; a touch panel type display 71 and the like.

Figure 2:
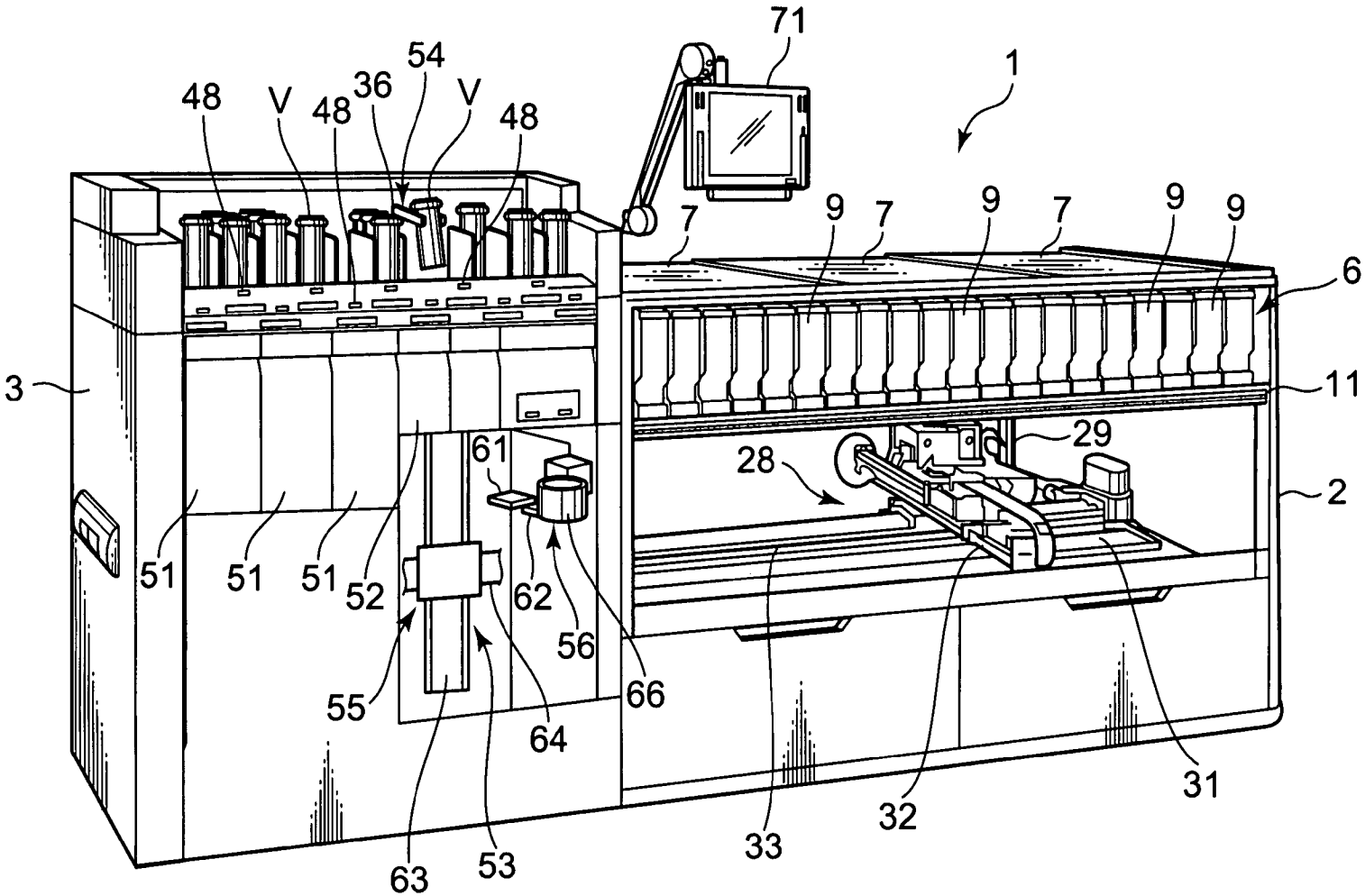
FIG. 2 is a schematic perspective view of a part of an inner constitution of the medicine supply apparatus.
Figure 3:
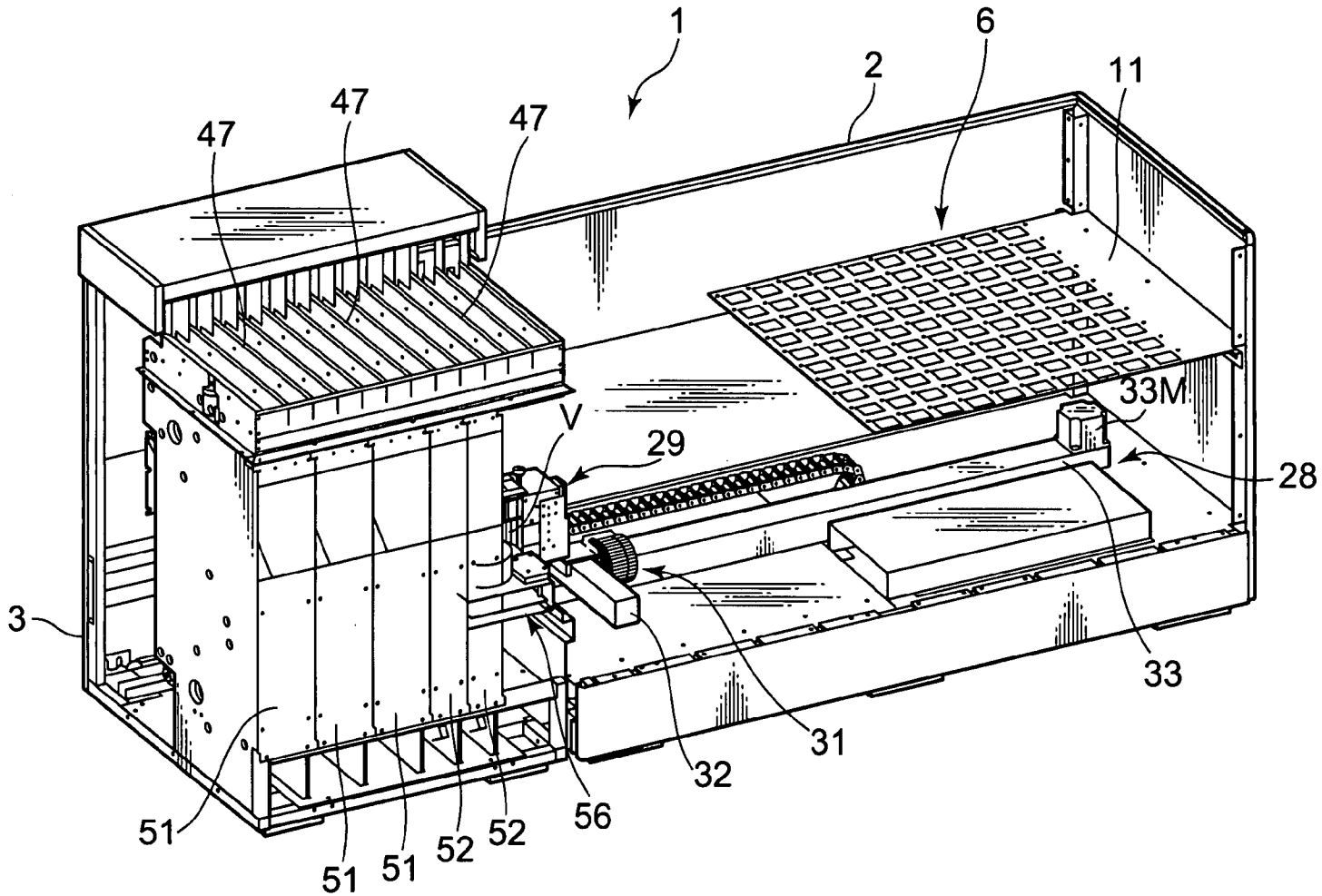
FIG. 3 is a front perspective view of the inner constitution of the medicine supply apparatus.

A plurality of rows of aligning conveyers 47 are partitioned from one another in the top of the providing unit 3, and the filled medicine bottle V is conveyed forwards. The fronts of the respective aligning conveyers 47 . . . are provided with the providing displays 48 corresponding to them, and names of those who are to be provided, such as patients, and the like are displayed in the providing displays 48. A providing device 55 is disposed in a rear part of the providing unit 3. As shown in FIG. 2, the conveying device 53 is constituted of a rail 63 disposed in a vertical direction (perpendicular direction, X-axis) and a rail 64 for moving the rail 63 in a lateral direction (Y-axis), and end portions of the rails 63, 64 are provided with conveying motors (not shown) in the same manner as in the conveying device 31. This motor moves the holder 54 (medicine bottle V) along the X-Y axis in vertical and horizontal directions in the rear part of the providing unit 3. It is to be noted that the holder 54 is provided with the holding arms 36 and motors in the same manner as in the holding device 29, but the holding arms 36 are moved forwards/backwards instead of raising/lowering them. In this case, tips of the holding arms 36, 36 are directed forwards, and are not provided with constitutions corresponding to the rotating motors.

Moreover, the medicine bottle units 51 . . . and the lid units 52, 52 are attached to the front of the providing unit 3, and detachably disposed in three medicine bottle storage sections and two lid storage sections of the providing unit 3, respectively. In this case, inner constitutions of the medicine bottle units 51 . . . differ with dimensions of the medicine bottles V to be stored, but outer shapes and basic constitutions of the units are the same. Even the medicine bottle unit 51 containing the medicine bottle V having any dimension can be attached to any of the three medicine bottle storage sections. Accordingly, the medicine bottle unit 51 for use can be arbitrarily selected and attached depending on the dimension of the medicine bottle V for use. That is, in a case where many medicine bottles V having large dimensions are used, it is assumed that all or two medicine bottle units 51 store the medicine bottles V having large dimensions and that the remaining medicine bottle unit 51 stores the medicine bottles V having small dimensions. Conversely, in a case where many medicine bottles V having small dimensions are used, it may be assumed that all or two medicine bottle units 51 store the medicine bottles V having small dimensions and that the remaining medicine bottle unit 51 stores the medicine bottles V having large dimensions.

Here, it is assumed that the medicine bottle V is a substantially cylindrical container made of a hard synthetic resin and having an open top and that the bottles have two types of large and small dimensions as described above depending on sizes or quantities of the medicines to be charged. Since the medicine bottle V is made of such hard resin, a peripheral side of the bottle is slightly tapered to open wide toward the upper opening. In the lid unit 52, there are stored a large number of lids for sealing the upper openings of the medicine bottles V.

Moreover, the label attaching device 56 is disposed on the side of the charging unit 2 in a front part of the providing unit 3, and constituted of: a rolled wound label 66 whose back is coated with an adhesive; a printer 67 for printing the surface of this label 66; a sensor 68 for detecting that the printed label 66 is delivered to a predetermined position and the like. After the label 66 is printed with the printer 67, it is fed between a pair of supports 69, 69 (FIGS. 17, 18). The sensors 68 are attached to inner faces of the supports 69, 69. An interval between the supports 69 and 69 is equal to that between the holding arms 36 and 36 of the holding device 29.

Furthermore, the photographing device 57 photographs the medicine bottle V from above before the bottle is filled with the medicine and closed with the lid, and records an image of the medicine in the bottle. The lid closing device 58 takes the lid from the lid unit 52, and attaches the lid to the upper opening of the medicine bottle V photographed by the photographing device 57 to seal the bottle. The transfer tables 61, 62 are disposed in two front and rear portions of the providing unit 3 behind the label attaching device 56 on the side of the charging unit 2, and can be raised and lowered by raising and lowering motors 61M, 62M so as to adjust heights of the tables.

(3) Control Device 72

Figure 20:
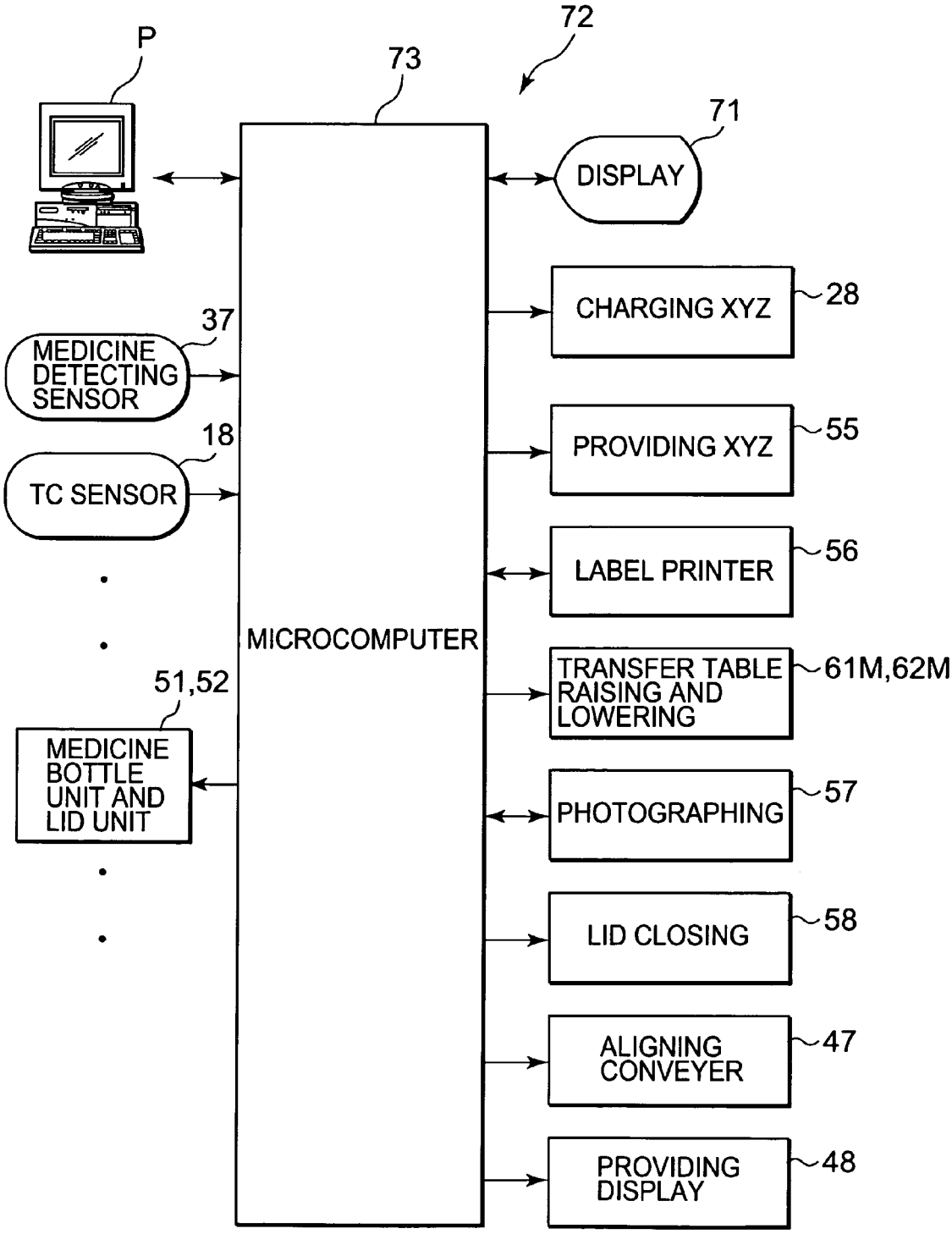
FIG. 20 is a circuit block diagram of a control device of the medicine supply apparatus.

Next, FIG. 20 shows a circuit block diagram of a control device 72 of the medicine supply device 1. The control device 72 is constituted of a microcomputer 73, and this microcomputer 73 is connected to the tablet case sensors 18 . . . and the medicine detecting sensor 37. The microcomputer 73 is also connected to the display 71, the charging device 28, the providing device 55, the label attaching device 56, the transfer table raising and lowering motors 61M, 62M, the photographing device 57, the lid closing device 58, the aligning conveyers 47 . . . , the providing displays 48 . . . , the medicine bottle unit 51, and the lid unit 52 to control them. The microcomputer 73 is also connected to an external personal computer P so as to communicate data.

(4) Operation of Medicine Supply Device 1

Next, there will be described an operation of the medicine supply device 1 constituted as described above. It is to be noted that it is assumed that in the microcomputer 73, there are input beforehand data on an address (position) of the tablet case 9 and the kind of medicine contained in the tablet case. In this case, in a case where any tablet case 9 is not attached to the attaching base 12, the microcomputer 73 grasps the address where any tablet case 9 is not attached based on an output of the tablet case sensor 18. Thereafter, any medicine bottle V is not moved to the corresponding address (position). In consequence, a useless control operation can be omitted, and a charging time can be reduced.

(4-1) Transfer of Empty Medicine Bottle V

Now, when predetermined prescription data is input into the microcomputer 73 via input from a touch panel of the display 71 or data communication from the personal computer P, the microcomputer 73 selects the medicine bottle V capable of containing the quantity of medicine designated by the prescription data, and drives each motor of the conveying device 53 of the providing device 55 to move the holder 54 to a takeout port 51A of the medicine bottle unit 51 in which the empty medicine bottles V are stored. Moreover, the microcomputer drives the holding motors of the holding arms 36, 36 to hold the empty medicine bottle V, and controls again the conveying device 53 to move the holder 54 to the transfer table 61. Moreover, the microcomputer releases the empty medicine bottle V from the holding arms 36, 36 to lay the bottle on a predetermined position of the transfer table 61.

(4-2) Charging of Medicine

Figure 21:
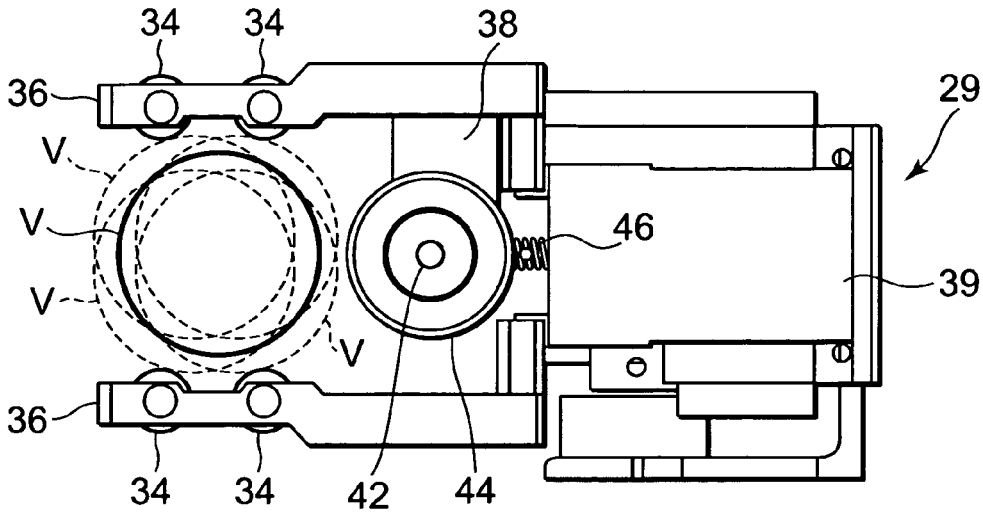
FIG. 21 is another plan view of the holding device of FIG. 12.

Next, the microcomputer 73 drives the respective motors 32M, 33M of the conveying device 31 of the charging device 28 to move the holding device 29 to the transfer table 61. Moreover, the microcomputer controls the holding motor 39 to hold the empty medicine bottle V on the transfer table 61 to hold the bottle between the rollers 34 . . . of the holding arms 36 and 36. In this case, the microcomputer 73 drives the raising and lowering motor 61M depending on the size of the selected empty medicine bottle V to adjust the height of the transfer table 61 so that the empty medicine bottle V can be held by the holding arms 36, 36 of the holding device 29 in the above-described holding position. That is, when the empty medicine bottle V has a large height and a large capacity, the transfer table 61 is lowered. When the empty medicine bottle V has a small height and a usual capacity, the transfer table is raised. Accordingly, the holding arm 36 of the holding device 29 can hold the empty medicine bottle V therebetween constantly in the holding position. It is to be noted that the microcomputer 73 also subjects the transfer table 62 to similar height adjustment by the raising and lowering motor 62M. In a case where the position of the empty medicine bottle V laid on the transfer table 61 deviates from a predetermined position, when the holding device 29 is moved to the transfer table 61, the position of the medicine bottle V falls in a position deviating from the predetermined position between the respective holding arms 36 and 36 as shown by a broken line in FIG. 21. However, when the holding arms 36, 36 are brought close to the medicine bottle V, the bottle surely first abuts on the holding roller 34 in the closest position, and is rotated and moved. The bottle successively abuts on the other holding roller 34, and is finally forcibly positioned in the predetermined position in the center of all of the holding rollers 34, 34, 34, and 34. Even in a case where the position (position in the horizontal direction) of the medicine bottle V on the transfer table 61 deviates, the holding rollers 34 . . . cooperate with one another to guide the medicine bottle V to the predetermined position. Therefore, a positioning precision is improved. This also applies to the holder 54.

When the holding device 29 holds the empty medicine bottle V, the microcomputer 73 drives the respective motors 32M, 33M of the conveying device 31 to move and dispose the holding device 29 and the empty medicine bottle V under the address of the tablet case 9 in which the medicine designated by the prescription is stored. Next, the lifting/lowering motor 41 is driven to raise the holding arms 36, 36, the medicine detecting sensor 37, the rotating motor 38, and the holding motor 39 to engage the driving gear 43 with the engagement gear 16 of the attaching base 12 as shown on the right side of FIG. 14 and FIG. 19.

(4-2-1) Control of Discharge Speed

Next, the microcomputer 73 drives the rotating motor 38 to rotate the discharge drum 13 via the driving gear 43, the engagement gear 16, and the engaging shaft 14. Accordingly, the medicines in the vertical groove 24 of the discharge drum 13 naturally drop one by one into the medicine bottle V via the chute 17 as described above. The medicine detecting sensor 37 detects that the medicine drops downwards from the lower end opening of the chute 17. The microcomputer 73 counts the number of the medicines which have dropped into the medicine bottle V based on the detecting operation of the medicine detecting sensor 37, and stops the rotating motor 38, when the quantity reaches that designated by the prescription, thereby ending the discharging and charging operation.

In this case, the microcomputer 73 adjusts the number of revolutions of the rotating motor 38 depending on the kind of medicine stored in the tablet case 9, and changes the discharge speed of the medicine. That is, when the medicine has a small size, a time for which the medicine passes the medicine detecting sensor 37 shortens. When the medicine has a round shape, the passage time similarly shortens (because the passage time of the medicine having a long shape lengthens). In this case, even when the number of revolutions of the rotating motor 38 is increased to increase the discharge speed of the medicine from the discharge drum 13, the medicine detecting sensor 37 can detect the medicine without any trouble. Therefore, the microcomputer 73 sets the number of revolutions (large number of revolutions, e.g., 70 RPM or the like) of the rotating motor 38 to be larger than the usual number of revolutions (e.g., 40 RPM or the like) described later to increase the discharge speed and shorten the charging time based on the preset kind of medicine with respect to the tablet case 9 of the address in a case where the size of the medicine is smaller than a predetermined reference value (assuming that the reference value is predetermined so as to judge the size of the medicine) and/or a case where the medicine has a round shape (including a shape approximate to the round shape). It is to be noted that in a case where the medicine has a large size, the rotating motor 38 is set to the usual number of revolutions. In the present embodiment, the number of revolutions of this rotating motor 38 is changed to two stages (the usual number of revolutions and the large number of revolutions). In addition, the number of revolutions may be finely controlled into stages such as three stages, or may be continuously changed (in a range of, e.g., 30 to 70 RPM) depending on the kind of medicine (size, shape).

Moreover, the microcomputer 73 decreases the number (e.g., 10 RPM) of revolutions of the rotating motor 38 to slow down the discharge speed of the medicine just before completing the counting of the medicines based on the detecting operation of the medicine detecting sensor 37, that is, when the counted quantity reaches five medicines (predetermined remaining quantity) before the designated quantity). This improves a detecting precision by the medicine detecting sensor 37. That is, this control improves a medicine counting precision while reducing the medicine charging time as described above. Especially, when the number of revolutions of the rotating motor 38 is set to be small, the discharge drum 13 is precisely stopped in a normal position. This prevents excessive discharge, and also improves a discharge precision.

It is to be noted that the driving roller 44 also rotates during such medicine discharge operation, but as shown in FIGS. 12, 13, the driving roller 44 does not abut on the medicine bottle V held by the holding arms 36, 36. Here, as described above, the peripheral side of the medicine bottle V is tapered so as to expand toward the upper opening. Therefore, when the driving roller 44 abuts on the medicine bottle V during such discharge operation, the medicine bottle V is also rotated by driving the rotating motor 38. On the other hand, since the rotations are performed several tens of times or more during the discharge operation, there is a danger that the medicine bottle V having the tapered peripheral side moves and deviates upwards. However, as shown in FIGS. 12, 13, the driving roller 44 is prevented from being brought into contact with the medicine bottle V during the medicine discharge operation to prevent such disadvantage. Here, each of the holding rollers 34 . . . is tapered in accordance with the taper of the medicine bottle V, but in actual, a taper value differs with the size of the medicine. Therefore, it is impossible to impart a completely matched taper to the holding roller 34. Therefore, the above-described constitution further exerts its effect. On the other hand, when the holding roller 34 is vertically halved (to obtain eight rollers in total in the embodiment), the taper of the roller can be completely matched with that of the medicine bottle V. In consequence, a holding force can be increased to realize stable conveyance. However, the taper of the holding roller 34 can be removed unless the increase of the holding force is demanded. A material of the holding roller 34 is preferably rubber-based because the holding force of the medicine bottle V by the material is larger than that by a metal-based material.

(4-2-2) Medicine Overflow Preventive Control

Here, there occurs a problem that the medicines discharged from the tablet case 9 overflow the medicine bottle V, for example, in a case where there is a mistake in the preset size of the medicine, and the size of the selected medicine bottle V is smaller than the total quantity of the medicines to be charged or a case where the rotating motor 38 and the control system break.

In such a case, the medicines are piled up to protrude upwards from the upper opening just before they overflow the medicine bottle V. On the other hand, the upper opening of the medicine bottle V held in the predetermined holding position is remarkably close to the medicine detecting sensor 37 under the sensor. When the medicines drop, the medicine detecting sensor 37 detects the passing medicine. Therefore, the output of the sensor forms a pulse. However, when the medicines are piled up to protrude upwards from the upper opening of the medicine bottle V, the medicine detecting sensor 37 continuously detects this pile of raised medicines, and the output becomes continuous without emitting any pulse.

When the medicine detecting sensor 37 continuously detects the medicines in this manner, the microcomputer 73 judges that the medicines are going to overflow the medicine bottle V, and stops the rotating motor 38 to stop the rotation of the discharge drum 13. In this case, a switch may be separately disposed in a power supply path to the rotating motor 38 for a case where the rotating motor 38 becomes uncontrollable. Accordingly, the discharging of the medicines is stopped before the medicines overflow the medicine bottle V, and it is possible to avoid in advance the disadvantage that the medicines overflow the medicine bottle V. Moreover, a predetermined overflow alarm is displayed in the display 71 (constituting alarming means) to thereby warn an operator (pharmacist or the like) that the medicines are to overflow the medicine bottle V. Consequently, a user can quickly handle the problem.

(4-3) Label Attaching

Figure 5:
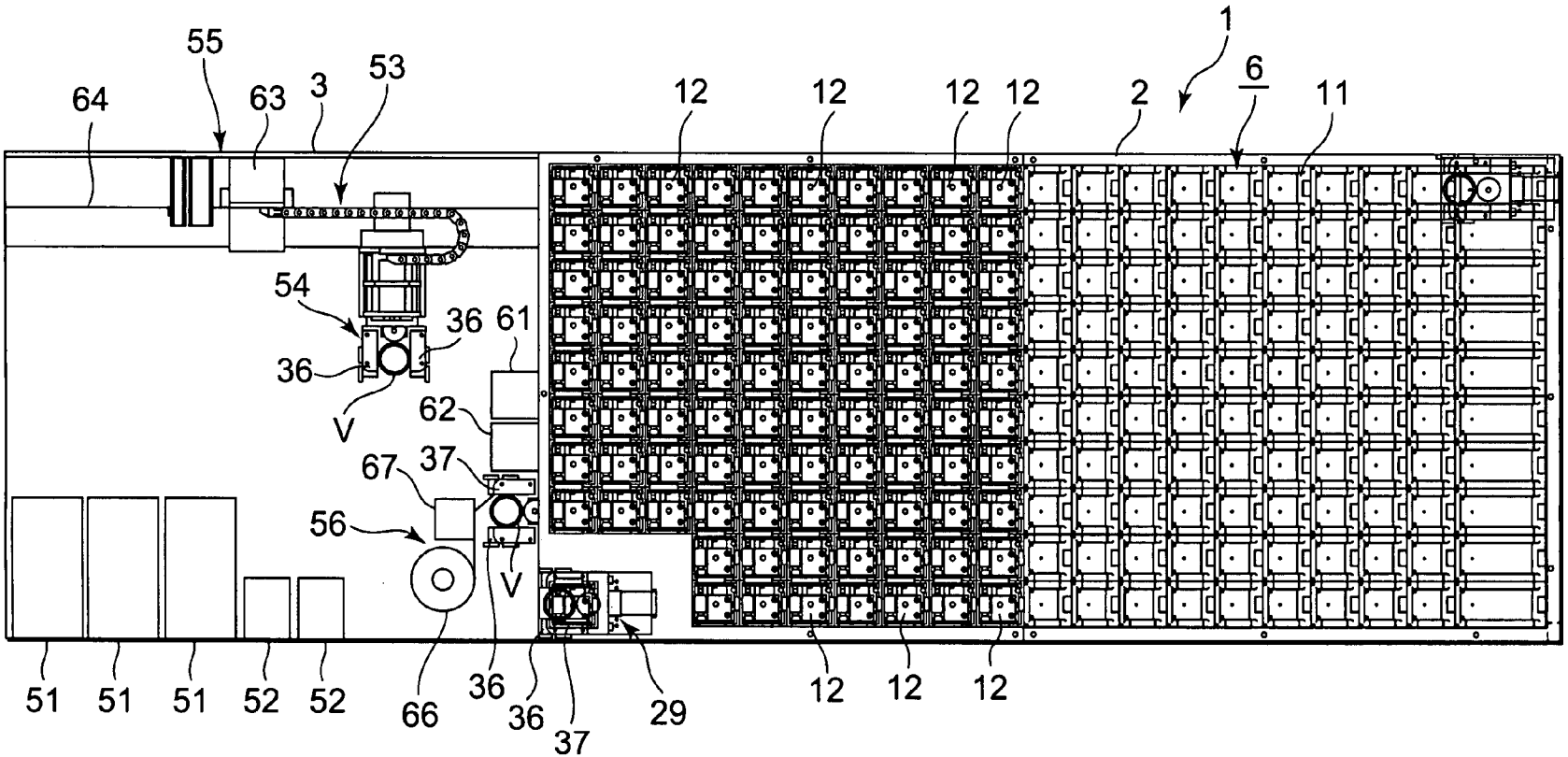
FIG. 5 is similarly a plan view.

After the medicine bottle V is filled with the quantity of the medicines designated by the prescription in this manner, the microcomputer 73 drives the raising and lowering motor 41 to lower the holding arms 36, 36, the medicine detecting sensor 37, the rotating motor 38, and the holding motor 39 (FIG. 11, the left side of FIG. 14). Next, the microcomputer 73 drives the respective motors 32M, 33M of the conveying device 31 of the charging device 28 to move the holding device 29 to the label attaching device 56 (FIG. 5). In this position (label attaching position), the holding arms 36, 36 of the holding device 29 are disposed in positions corresponding to those of the supports 69, 69 of the label attaching device 56.

During the charging of the medicines or after moving the holding device 29 to the label attaching device 56, the microcomputer 73 allows the printer 67 to print, on the surface of the label 66, information on dosing, such as the name of the patient who is a person to be provided with the medicine bottle V, the name of the medicine, and dosage and administration. Next, the label 66 is fed between the supports 69 and 69. When the sensor 68 detects the tip of the label, the microcomputer drives the motor 33M of the conveying device 31 to press the holding arms 36, 36 of the holding device 29 onto the supports 69, 69. According to this pressing operation, the holding arms 36, 36 and the holding motor 39 are moved toward the base portions of the holding arms 36, 36 against the coil spring 46. Therefore, as shown in FIGS. 17 and 18, the driving roller 44 abuts on the side (outer surface) of the medicine bottle V. Here, a gap between the medicine bottle V and the driving roller 44 is, for example, about 4 mm in a case where the medicine bottle V has a large size, and, for example, about 2 mm in a case where the medicine bottle V is large in a state in which the medicine bottle V is held between the holding arms 36 and 36 as shown in FIG. 13. The microcomputer 73 drives the motor 33M to move the holding device 29 toward the support 69. When the holding arms 36, 36 abut on the support 69, the holding device 29 is moved further 2 mm for the large medicine bottle V, and further 4 mm for the small medicine bottle V toward the support 69, and the holding motor 39 is moved toward the base portion of the holding arm 36. Accordingly, the driving roller 44 abuts on the side of the medicine bottle V. It is to be noted that when the size of the medicine bottle V is set to be smaller (thinner) or larger (thicker), the microcomputer 73 changes a movement amount of the holding device 29 after the holding arm 36 abuts on the support 69 in accordance with a preset gap dimension between the medicine bottle V and the driving roller 44.

In this case, the tip of the printed label 66 comes into contact with the side (outer surface) of the medicine bottle V (FIG. 18). The microcomputer 73 drives the rotating motor 38 at a time when the sensor 68 is interrupted by the tip of the label 66, and stops the rotating motor 38, for example, one second (predetermined time) after the label 66 passes the sensor 68. Since the driving roller 44 abuts on the side of the medicine bottle V as described above, the medicine bottle V rotates with the rotation of the driving roller 44. Since the label 66 is cut by a predetermined portion, or precut, the printed label 66 is drawn and attached while sticking to the side (outer surface) of the medicine bottle V under the control of the rotating motor 38. Such constitution can totally automate the filling of the medicine bottle V with the medicine to the attaching of the label. The label 66 can be attached to the outer surface of the medicine bottle V by use of the rotating motor 38 for rotating the discharge drum 13 to discharge the medicine from the tablet case 9. In consequence, the number of components and costs can be remarkably reduced.

(4-4) Transfer of Filled Medicine Bottle V

After attaching the label 66 to the side of the medicine bottle V in this manner, the microcomputer 73 drives the motor 33M of the conveying device 31 to detach the holding arms 36, 36 of the holding device 29 from the supports 69, 69. Next, the motors 32M, 33M of the conveying device 31 are controlled to move the holding device 29 to the transfer table 62. Moreover, the filled medicine bottle V is released from the holding arms 36, 36, and laid on the transfer table 62. In this state, the microcomputer 73 allows the photographing device 57 to photograph the medicine bottle V from above, and takes in an image of the medicine in the medicine bottle V to store the image in a storage device. Since the stored image can be displayed in the display 71, the medicine charged in the medicine bottle V can be easily confirmed. Consequently, erroneous providing of the medicine can be avoided in advance, or the image becomes useful in investigating a cause for the erroneous providing.

(4-5) Providing of Medicine

Next, the microcomputer 73 controls the conveying device 53 of the providing device 55 to move the holder 54 to the transfer table 62. Moreover, the motor is controlled to hold the filled medicine bottle V with the holding arms 36, 36 on the transfer table 62. Furthermore, the conveying device 53 is controlled to move the holder 54 and the medicine bottle V to the lid closing device 58 disposed as high as the transfer table 62 in the vicinity of the transfer table, and the upper opening of the medicine bottle V is covered with the lid discharged from the lid unit 52 to seal the opening. Next, the microcomputer 73 controls the conveying device 53 to raise the medicine bottle V closed with the lid. Moreover, the bottle is moved horizontally, and laid on the predetermined aligning conveyers 47 on the top of the providing unit 3. Even when the medicine bottle V is raised and moved horizontally, the bottle is closed with the lid, thereby prevented the contained medicine from being spilled. Moreover, the aligning conveyer 47 conveys the laid medicine bottle V forwards to align it in a predetermined providing position.

The microcomputer 73 turns off the providing display 48 disposed after the aligning conveyer in a case where there is not any medicine bottle V on the aligning conveyer, blinks the providing display 48 during the aligning and providing of the medicine bottle V, and continuously turns on the providing display 48 in a case where the alignment is completed. The microcomputer 73 displays, in the providing display 48, the name of the patient who is the person to be provided with the medicine bottle V, or specifying information from a time when the bottles are aligned. The microcomputer turns off the display in a case where the medicine bottle V is taken out. Consequently, the medicine bottles V are classified for each person to be provided, aligned, and provided. Therefore, the operator can easily and securely find the medicine bottle V to be provided to the patient. In consequence, smooth medicine providing is realized, and erroneous medicine providing can be avoided in advance.

Moreover, since the empty medicine bottle V and the filled medicine bottle V are transferred between the charging unit 2 and the providing unit 3 via the transfer tables 61, 62, the smooth medicine bottle conveyance can be realized while remarkably simplifying the constitution of the conveying device even in a case where the conveying direction (horizontal direction) of the medicine bottle V to be filled with the medicine is different from that (vertical direction) of the medicine bottle V for providing the medicine.

Here, since two transfer tables are disposed in the present embodiment, the empty medicine bottle V can be laid on the transfer table 61 while the filled medicine bottle V is laid on the transfer table 62. Therefore, the microcomputer 73 allows the conveying device 53 to convey the empty medicine bottle V onto the transfer table 61 irrespective of an operating situation of the conveying device 31 in a case where there is not any empty medicine bottle V on the transfer table 61. Moreover, when the photographing of the filled medicine bottle V on the transfer table 62 is completed, the filled medicine bottle V is conveyed to the lid closing device 58 by the conveying device 53. When the empty medicine bottle V exists on the transfer table 61, the conveying device 31 is moved to hold the empty medicine bottle V and execute an operation of filling the medicine bottle V with the medicine irrespective of the operating situation of the conveying device 53. When there is not any filled medicine bottle V on the transfer table 62, the filled medicine bottle V provided with the label 66 is conveyed onto the transfer table 62 by the conveying device 31.

That is, since the moving of the medicine bottle V (the empty and filled medicine bottles) by the conveying device 53 is performed simultaneously with the moving of the medicine bottle V (the filled and empty medicine bottles) by the conveying device 31, the medicine supply operation can be performed quickly.

It is to be noted that in the present embodiment, the overflow of the medicine is judged using the medicine detecting sensor 37 for use in counting the medicines discharged from the tablet case 9. However, the medicine bottle V is usually molded of a translucent hard synthetic resin. Therefore, when an infrared sensor is disposed right under the upper opening of the medicine bottle V, the infrared sensor can detect the medicine to thereby detect that the medicine is going to overflow. In this case, the infrared sensor needs to be separately disposed unlike the above-described embodiment, but the overflow can be judged before the medicines are raised from the upper opening of the medicine bottle V. This can further improve an overflow preventing effect.

What is claimed is:

1. A medicine supply apparatus arranged to fill medicine bottles of variant sizes, based on prescription data, with a medicine, comprising:

a charging unit which contains a plurality of tablet cases, each tablet case comprising a storage container, removable from the charging unit and having an open top which is openably closed with a lid, which contain the medicines and into which the medicines are provided from above;

a case storage section in which the respective tablet cases are juxtaposed on a common plane, a top of the case storage section being openably closed;

filling means disposed under the case storage section and arranged to fill medicine bottles having different dimensions with the medicine dropping from a predetermined tablet case of said plurality of tablet cases, the filling means having a medicine bottle holding means for holding the medicine bottle; and a providing means, horizontally adjacent the charging unit, having a height adjustable transfer table for transferring the medicine bottles having different dimensions to the charging unit at a predetermined height.

2. The medicine supply apparatus according to claim 1, wherein the filling means comprises: the medicine bottle holding means for holding the medicine bottle; and conveyance means for moving the medicine bottle holding means in a horizontal direction to dispose the medicine bottle under the predetermined tablet case.

3. The medicine supply apparatus according to claim 2, comprising:

discharge means for dropping the medicine from each tablet case, the medicine bottle holding means comprising:

driving means for driving the discharge means;

raising and lowering means for vertically moving the driving means to disengageably engage the driving means with the discharge means; and medicine detecting means for detecting medicine dropping from the predetermined tablet case.

4. The medicine supply apparatus according to claim 1, further comprising:

label attaching means, horizontally adjacent the charging unit, for attaching a label to the medicine bottle filled with the medicine by the filling means;

lid closing means for closing the medicine bottle filled with the medicine with a lid; and providing means for conveying the medicine bottle provided with the label and closed with the lid to a predetermined position.

5. The medicine supply apparatus according to claim 1, further comprising:

detecting means in the charging unit arranged to detect the presence of the predetermined tablet case.

6. A medicine supply apparatus arranged to fill medicine bottles of variant sizes, based on prescription data, with a medicine, comprising:

a charging unit which contains a plurality of tablet cases, each tablet case comprising a storage container, removable from the charging unit and having an open top which is openably closed with a lid, which contain the medicines;

filling means arranged to fill medicine bottles having different dimensions with the medicine discharged from a predetermined tablet case; and providing means, horizontally adjacent the charging unit, for closing the medicine bottle filled with the medicine with a lid and conveying the medicine bottle to a predetermined position with use of a height adjustable transfer table, the filling means in the charging unit comprising:

filling medicine bottle holding means for holding the medicine bottle; and filling conveyance means for moving the filling medicine bottle holding means, the providing means comprising:

a medicine bottle storage section in which an empty medicine bottle is stored;

providing medicine bottle holding means for holding the medicine bottle; and providing conveyance means for moving the providing medicine bottle holding means, wherein the filling means and the providing means are arranged to receive and transfer the medicine bottle therebetween via a predetermined transfer base having the height adjustable transfer table.

7. The medicine supply apparatus according to claim 6, wherein the providing means holds an empty medicine bottle of the medicine bottle storage section by means of the providing medicine bottle holding means, and moves the providing medicine bottle holding means to the transfer base by means of the providing conveyance means to dispose the empty medicine bottle on the transfer base, the filling means in the charging unit holds the empty medicine bottle on the transfer base by means of the filling medicine bottle holding means, moves the filling medicine bottle holding means by means of the filling conveyance means to fill the medicine bottle with the medicine discharged from the tablet case, and moves again the filling medicine bottle holding means to the transfer base to dispose the filled medicine bottle on the transfer base, and the providing means, horizontally adjacent the charging unit, holds the filled medicine bottle on the transfer base by means of the providing medicine bottle holding means to convey the medicine bottle to a predetermined position.

8. The medicine supply apparatus according to claim 6, wherein the providing means comprises a plurality of medicine bottle storage sections detachably provided with medicine bottle units containing empty medicine bottles having different dimensions.

9. The medicine supply apparatus according to claim 6, wherein the providing means conveys the filled medicine bottle to a predetermined providing position.

10. A medicine supply apparatus arranged to fill a medicine bottle with a medicine discharged from a predetermined tablet case, comprising:

discharge means for discharging the medicine from the predetermined tablet case;

label attaching means for printing a label to be attached to the medicine bottle arranged to provide the label to a predetermined label attaching position; and filling means, contained in a charging unit, arranged to fill the medicine bottle with the medicine discharged from the predetermined tablet case, the filling means comprising:

medicine bottle holding means for holding the medicine bottle by means of a holding roller;

conveyance means for moving the medicine bottle holding means to dispose the medicine bottle under the predetermined tablet case and in the label attaching position; and driving means, the driving means driving the discharge means, when the medicine bottle is positioned under the predetermined tablet case, the driving means rotating the medicine bottle to attach the label to the medicine bottle, when the medicine bottle is disposed in the label attaching position.

11. The medicine supply apparatus according to claim 10, comprising:

a driving gear and a driving roller which are disposed on a driving shift of the driving means, the filling means engaging the driving gear with the discharge means to drive the discharge means such that the driving roller is detached from the medicine bottle, when the medicine bottle is positioned under the predetermined tablet case, the filling means bringing the driving roller into contact with an outer face of the medicine bottle to rotate the medicine bottle, when the medicine bottle is disposed in the label attaching position.

12. The medicine supply apparatus according to claim 10, wherein the medicine bottle holding means comprises a pair of holding arms which are brought close to and detached from each other, each holding arm comprises a pair of holding rollers, and the respective holding arms are brought close to each other to rotatably hold the medicine bottle by means of each holding roller.

13. A medicine supply apparatus arranged to fill medicine bottles of variant sizes, based on prescription data, with a medicine, comprising:

a charging unit which contains a plurality of tablet cases, each tablet case comprising a storage container, removable from the charging unit and having an open top which is openably closed with a lid, which contain the medicines and into which the medicines are provided from above;

a case storage section in which the respective tablet cases are juxtaposed on a common plane a top of the case storage section being openably closed;

a medicine bottle holding device, disposed under the case storage section and arranged to receive medicine dropping from a predetermined tablet case;

a conveyor arranged to move the medicine bottle holder in a horizontal direction to dispose a medicine bottle of a predetermined size under said predetermined tablet case; and a providing means, horizontally adjacent the charging unit, having a height adjustable transfer table for transferring the medicine bottles having different dimensions to the charging unit at a predetermined height.

14. A medicine supply apparatus arranged to fill medicine bottles of variant sizes, based on prescription data, with a medicine comprising:

a charging unit which contains a plurality of tablet cases, each tablet case comprising a storage container, removable from the charging unit and having an open top which is openably closed with a lid, which contain the medicines;

a medicine bottle storage section arranged to store empty medicine bottles of variant sizes;

a medicine bottle holding device arranged to receive an empty medicine bottle from the storage section;

a conveyor arranged to move the medicine bottle holding device, with an empty medicine bottle of a predetermined size thereon, to receive medicine from a predetermined tablet case; and a providing unit, horizontally adjacent the charging unit, arranged to close the medicine bottle, filled with medicine, with a lid and convey the medicine bottle to a predetermined position, and having a height adjustable transfer table for transferring the medicine bottles having different dimensions to the charging unit at a predetermined height.

15. A medicine supply apparatus arranged to fill medicine bottles of variant sizes, based on prescription data, with a medicine, comprising:

a charging unit which contains a plurality of tablet cases, each tablet case comprising a storage container, removable from the charging unit and having an open top which is openably closed with a lid, which contain the medicines;

a medicine bottle storage section arranged to store empty medicine bottles;

a medicine bottle holding device arranged to receive an empty medicine bottle from the storage section;

a conveyor arranged to move the medicine bottle holding device, with an empty medicine bottle of a predetermined size thereon, to receive medicine from a predetermined tablet case;

a transfer base;

a filling unit that holds the empty medicine bottle on the transfer base by the medicine bottle holding device, removes the medicine bottle holding device for filling of the medicine bottle with medicine, and returns the filled medicine bottle on the medicine bottle holding device to the transfer base; and a providing unit for holding the filled medicine bottle on the transfer base by means of the medicine bottle holding device to convey the medicine bottle to a predetermined position and having a height adjustable transfer table for transferring the medicine bottles having different dimensions to the charging unit at a predetermined height.

16. A medicine supply apparatus arranged to fill a medicine bottle with a medicine discharged from a predetermined tablet case, comprising:

a discharge drum arranged to discharge medicine from the predetermined tablet case;

a label attaching unit for printing a label and provide the printed label at a label attaching position;

a medicine bottle storage section arranged to store empty medicine bottles;

a medicine bottle holding device, having a holding roller, arranged to receive an empty medicine bottle from the storage section;

a conveyor arranged to move the medicine bottle holding device with an empty medicine bottle thereon to receive medicine from a predetermined tablet case and position the medicine bottle at a label attaching position; and a motor arranged to drive the discharge drum and rotate the medicine bottle to attach the label to the medicine bottle, when the medicine bottle is disposed in the label at attaching position.

* * * * *